US006102712A

United States Patent [19]

Nishimura

[11] Patent Number: 6,102,712

[45] Date of Patent: Aug. 15, 2000

[54] BOARD-MOUNT CONNECTOR

[75] Inventor: Kouji Nishimura, Tokyo, Japan

[73] Assignee: Fujitsu Takamisawa Component Limited, Tokyo, Japan

[21] Appl. No.: 09/129,751

[22] Filed: Aug. 5, 1998

[30] Foreign Application Priority Data

Aug. 12, 1997 [JP] Japan ..... 9-217500
Nov. 11, 1997 [JP] Japan ..... 9-308469

[51] Int. Cl.[7] ..... H01R 12/00

[52] U.S. Cl. ..... 439/79; 439/83; 439/931

[58] Field of Search ..... 439/79, 931, 80, 439/83

[56] References Cited

U.S. PATENT DOCUMENTS 5,030,113 7/1991 Wilson ..... 439/931
5,158,470 10/1992 Zarreii ..... 439/931
5,522,727 6/1996 Saito et al. ..... 439/79
5,873,751 2/1999 Daly et al. ..... 439/931

*Primary Examiner*—Renee Luebke
*Assistant Examiner*—T. C. Patel
*Attorney, Agent, or Firm*—Staas & Halsey LLP

[57] ABSTRACT

A board-mount connector for a circuit board, including a plurality of contact elements, an electro-insulating body for supporting the contact elements in a mutually insulated arrangement, a plurality of external terminals located on an outer surface of the electro-insulating body, and a plurality of electro-conductive paths formed on a surface of the electro-insulating body to be electrically connected with respective ones of the contact elements and respective ones of the external terminals. The electro-conductive paths include a first terminal layer formed to cover an inner surface of a through hole for holding the contact element, a conductive line continuously formed on the outer surface of the electro-insulating body to be electrically connected at one end thereof with the first terminal layer, and a second terminal layer formed on the outer surface of the electro-insulating body to be electrically connected with the other end of the conductive line. Each external terminal is provided on the second terminal layer.

19 Claims, 25 Drawing Sheets

BOARD-MOUNT CONNECTOR

BACKGROUND OF THE INVENTION

1. Field of the Invention

The present invention relates generally to an electrical connecting device and, more particularly, to a connector adapted to be mounted on the surface of a circuit board.

2. Description of the Related Art

Various types of connector systems used for connecting a circuit board with another electrical component are well known in the art. One example of conventional board-mount connectors in such connector systems, which is adapted to be mounted on the surface of a circuit board, includes a plurality of contact elements and an electro-insulating body for supporting the contact elements in several rows. The electro-insulating body is provided with a mount surface adapted to face the surface of the circuit board when the connector is mounted on the board surface.

When the contact ends of the contact elements, adapted to be engaged with counterpart contact elements of counterpart connector, are supported in the electro-insulating body so as to extend in parallel to the mount surface of the latter, the contact elements are generally shaped in a "right angled" profile. In this case, when the contact elements are arranged in a matrix with several rows, the terminal ends opposed to the contact ends of the contact elements, adapted to be connected to the circuit of the circuit board, should be offset or bent to avoid interference between the adjacent contact elements. Therefore, this type of conventional board-mount connector should include different types or shapes of contact elements, the number of which corresponds to the number of rows of the contact elements.

The use of the different types of contact elements tends to increase the number of steps for producing the connector, and thus to deteriorate the productivity of the conventional board-mount connector. Also, when the rows of the contact elements are increased in the conventional board-mount connector, the pitch or distance between the terminal ends or external terminals of the contact elements is decreased, which causes a problem of short circuits.

On the other hand, the circuit board on which the conventional board-mount connector is mounted, should be provided with terminals of the circuit in the area outside the mounted connector. Consequently, the area for mounting other electrical devices on the board surface is reduced, which makes it difficult to ensure the desired high density mounting performance of the circuit board.

Further, when the conventional board-mount connector is mounted on the circuit board, the distal ends of the terminal ends of the contact elements should be aligned with each other in a common plane to ensure the proper self-positioning of the terminal ends on the circuit board. Such an alignment of the terminal ends may be readjusted just before mounting the connector on the circuit board as occasion demands, which makes the mounting operation troublesome.

SUMMARY OF THE INVENTION

It is therefore an object of the present invention to provide a connector capable of being used as a board-mount connector, which can improve the productivity and mounting operation of the board-mount connector.

It is another object of the present invention to provide a connector which can prevent a short circuit between adjacent terminal ends or external terminals even when the rows of the contact elements are increased.

It is a further object of the present invention to provide a board-mount connector which can ensure the desired high density mounting performance of a circuit board.

In accordance with the present invention, there is provided a connector, comprising a plurality of contact elements; an electro-insulating body for supporting the contact element in a mutually insulated arrangement; a plurality of external terminals located on an outer surface of the electro-insulating body; and a plurality of electro-conductive paths formed on a surface of the electro-insulating body to be electrically connected with respective ones of the contact elements and respective ones of the external terminals.

In the preferred aspect of the present invention, the electro-conductive paths are formed as conductive laminas in a certain pattern on the surface of the electro-insulating body.

It is advantageous that the electro-conductive paths include terminal layers formed in a desired array on the outer surface of the electro-insulating body, and that the external terminals include solder bumps provided on respective one of the terminal layers.

In this arrangement, the terminal layers of the electro-conductive paths may be grouped together in a local area on the outer surface of the electro-insulating body.

It is preferred that the electro-insulating body is provided in a desired array on the outer surface with C-shaped projections, each having a height not higher than a height of each solder bump, and wherein the terminal layers are formed inside respective ones of the C-shaped projections.

It is advantageous that the electro-insulating body is provided in a desired array on the outer surface with depressions, the electro-conductive paths being also formed in the depressions, and wherein the terminal layers are formed adjacent to respective ones of the depressions.

It is also preferred that the electro-conductive paths are provided locally with metal surface areas having little wetability for solder, the metal surface areas being located adjacent to respective ones of the terminal layers.

In this arrangement, the metal surface areas may be made of nickel layers.

It is also advantageous that the external terminals include terminal elements securely supported in a desired array on the outer surface of the electro-insulating body.

In this arrangement, the terminal elements may be grouped together in a local area on the outer surface of the elector-insulating body.

The electro-insulating body may include through holes for securely holding therein respective ones of the contact elements, and the electro-conductive paths may include first terminal layers formed to cover inner surfaces of the through holes, conductive lines formed in a certain pattern on the outer surface of the electro-insulating body to be electrically connected at one of the ends thereof with the first terminal layers, and second terminal layers formed in a desired array on the outer surface of the electro-insulating body to be electrically connected with the other ends of the conductive lines, the external terminals being provided on the second terminal layers.

In this arrangement, the external terminals may include solder bumps provided on respective ones of the second terminal layers.

Alternatively, the electro-insulating body may be provided on the outer surface with a plurality of grooves, the second terminal layers of the electro-conductive paths being formed to cover inner surfaces of the grooves, and the external terminals may include terminal elements press-fitted into respective ones of the grooves.

It is also preferred that the electro-insulating body is provided on the outer surface with a recessed portion, the electro-conductive paths being formed on a surface of the recessed portion.

The contact elements may include contact ends adapted to be engaged with counterpart contact elements, fixing portions adjacent to the contact ends to be fixed in the electro-insulating body, and terminal ends adjacent to the fixing portions opposite to the contact ends, the terminal ends slightly projecting from the outer surface of the electro-insulating body.

The present invention also provides a board-mount connector for a circuit board, comprising: a plurality of contact elements having a substantially straight shape; an electro-insulating body for supporting the contact elements in a mutually parallel, insulated arrangement, the electro-insulating body including a mount surface extending substantially parallel to the contact elements and adapted to face a surface of the circuit board; a plurality of external terminals located on the mount surface of the electro-insulating body; and a plurality of electro-conductive paths formed on the mount surface and another adjacent to the mount surface of the electro-insulating body to be electrically connected with respective ones of the contact elements and respective ones of the external terminals.

It is preferred that the external terminals are grouped together in a local area in a desired area on the mount surface of the electro-insulating body.

The present invention further provides a board-mount connector for a circuit board, comprising: a plurality of contact elements having a substantially straight shape, each of the contact elements including a contact end adapted to be engaged with a counterpart contact element, a fixing portion adjacent to the contact end, and a terminal end adjacent to the fixing portion opposite to the contact end; an electro-insulating body for supporting the contact elements in a mutually parallel, insulated arrangement, the electro-insulating body including through holes arranged in a desired array, each of the through holes having dimensions for fixing therein the fixing portion of the each contact element, and the electro-insulating body including a mount surface extending substantially parallel to the contact elements and adapted to face a surface of the circuit board; a plurality of external terminals grouped together in a local area in a desired area on the mount surface of the electro-insulating body; and a plurality of electro-conductive paths formed on the mount surface and another surface adjacent to the mount surface of the electro-insulating body to be electrically connected with respective ones of the contact elements and respective ones of the external terminals, each of the electro-conductive paths including a first terminal layer formed to cover an inner surface of each through hole, a conductive line continuously formed on the mount surface and the other surface of the electro-insulating body to be electrically connected at one end thereof with the first terminal layer, and a second terminal layer formed on the mount surface of the electro-insulating body to be electrically connected with the other end of the conductive line, each of the external terminals being provided on the second terminal layer.

BRIEF DESCRIPTION OF THE DRAWINGS

The above and other objects, features and advantageous of the present invention will become more apparent from the following description of preferred embodiments in connection with the accompanying drawings, in which.

DESCRIPTION OF THE PREFERRED EMBODIMENT

Figure 1:
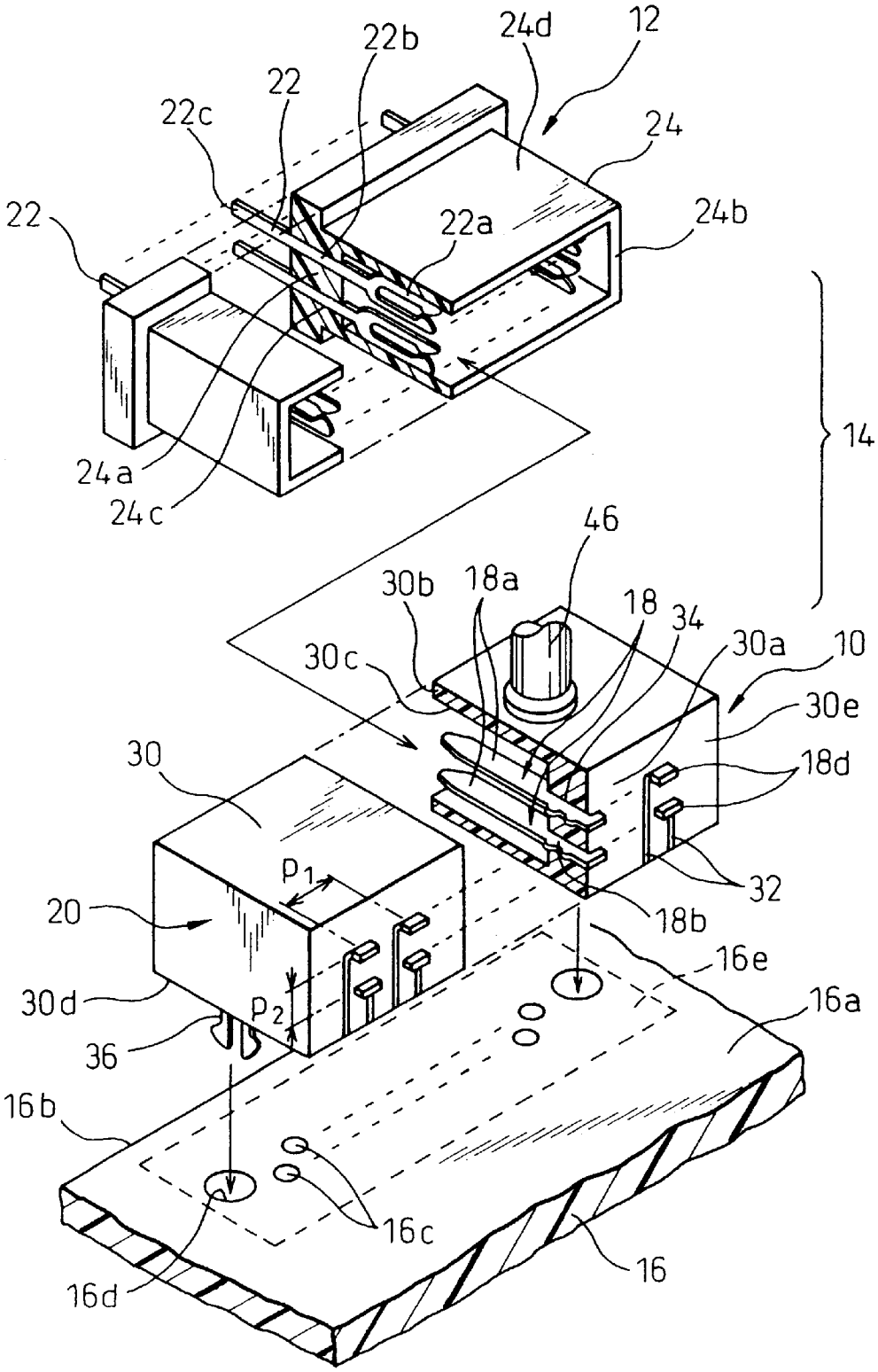
FIG. 1 is a partially cut-out perspective view of a plug connector according to the first embodiment of the present invention, together with a counterpart jack connector and a circuit board.

Referring to the drawings, wherein the same or similar components are designated by common reference numerals, FIG. 1 shows a surface-mount type plug connector 10 as a first embodiment of a board-mount connector according to the present invention. The plug connector 10 is adapted to be detachably connected to a jack connector 12, as shown by an arrow, to provide a connector system 14 which is suitably used for connection between a circuit board 16 and another electrical component (not shown).

The plug connector 10 of the first embodiment includes a plurality of plug-type contact elements 18 and a plug-type insulator 20 securely holding therein the contact elements 18 in a mutually insulated arrangement. The plural plug-type elements 18 are arranged parallel to each other in a matrix with two upper and lower rows, and are positioned in a constant pitch "$p_1$" or distance between side-by-side contact elements 18 in each row, and in a pitch "$p_2$" or distance between upper and lower rows.

The jack connector 12 includes a plurality of jack-type contact elements 22 and a jack-type electro-insulating body 24 securely holding therein the contact elements 22 in a mutually insulated arrangement. The plural jack-type contact elements 22 are arranged parallel to each other in a matrix with two upper and lower rows, and are positioned correspondingly to the plug-type contact elements 18 of the plug connector 10.

Figure 2A:
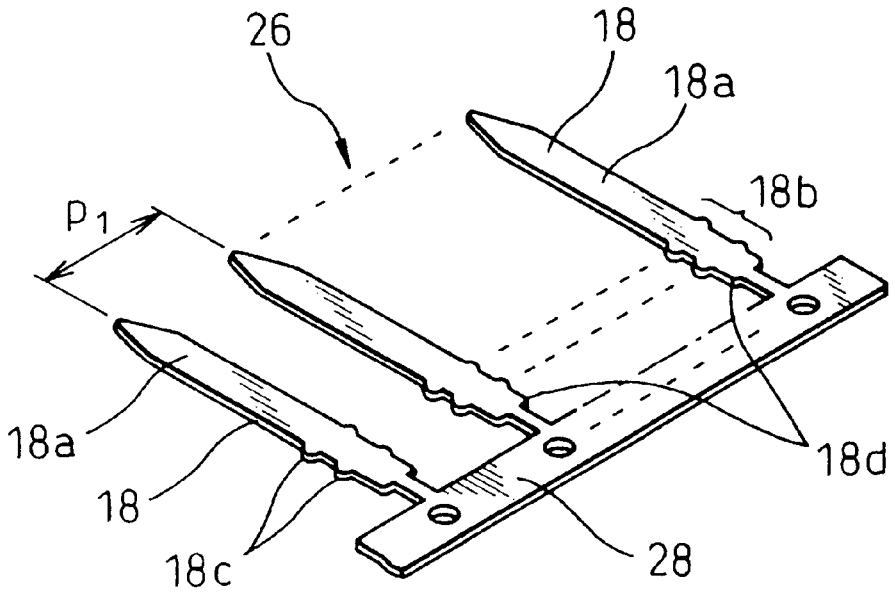
FIG. 2A is a perspective view of a blank having contact elements used in the plug connector of FIG. 1.
Figure 2B:
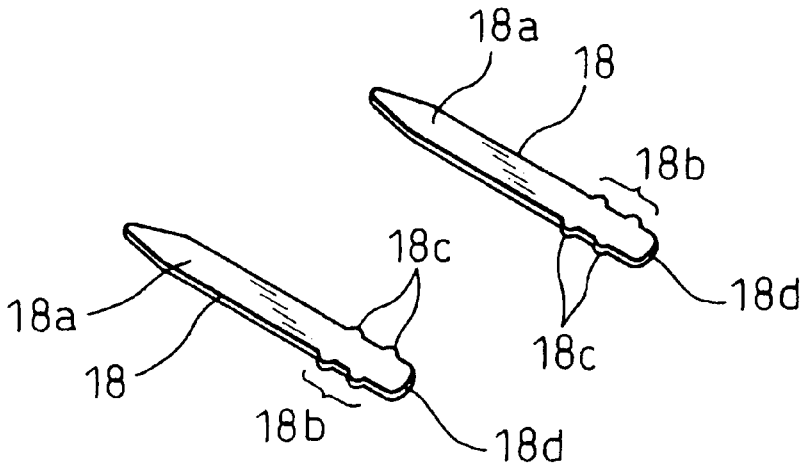
FIG. 2B is a perspective view of the contact elements of FIG. 2A.

As shown in FIGS. 2A and 2B, the plug-type contact elements 18 of the plug connector 10 are prepared by stamping out a metal sheet material by a conventional press technique into a blank 26 having a comb-teeth shape, in which the contact elements 18 are integrated or joined together through a joint member 28, and then by cutting or separating the joint member 28 from the contact elements 18. The plug-type contact elements 18 are integrated through the joint member 28 so as to be located in the pitch "$p_1$", i.e., in the same mutual positional relationship as that in the assembled state where the contact elements 18 are incorporated in the insulator 20.

Each plug-type contact element 18 has a straight, flat-plate shape, and includes a plug contact end 18*a* adapted to be in a sliding engagement with a jack contact end 22*a* of each counterpart jack-type contact element 22 of the jack connector 12, a fixing portion 18*b* longitudinally adjacent to the plug contact end 18*a* and provided with bulges 18*c* protruding from both the lateral edges of the contact element 18, and a terminal end 18*d* longitudinally adjacent to the fixing portion 18*b* opposite to the plug contact end 18*a*. The plug-type contact elements 18 in the blank 26 are respectively joined at the terminal ends 18*d* thereof to the joint member 28.

Referring again to FIG. 1, the plug-type insulator 20 includes a plug-type electro-insulating body 30 and a plurality of electro-conductive paths 32 formed on the surface of the electro-insulating body 30. The plug-type electro-insulating body 30 has a generally rectangular parallelepiped profile, and includes a contact supporting section 30*a* provided with a plurality of through holes 34 extending between the front and rear surface of the contact supporting section 30*a*, and a guide wall section 30*b* extending frontward from the peripheral edge area of the contact supporting section 30*a*.

The through holes 34 are arranged in a matrix with parallel upper and lower rows, and are positioned in the constant pitch "$p_1$" or distance between side-by-side through holes 34 in each row and in the pitch "$p_2$" or distance between upper and lower rows. Each through hole 34 has a generally rectangular cross section and a dimension sufficient to fix therein the fixing portion 18*b* of the plug-type contact element 18 with the aid of the bulges 18*c* thereof when the fixing portion 18*b* is inserted and press-fitted into the through hole 34, whereby the plug-type contact elements 18 are fixedly supported in parallel with each other in the contact supporting section 30*a*.

The plug-type-contact elements 18 are also supported in such a mutual positional relationship that the major faces of the contact elements 18 in one row are located in a common plane and those in another row are located in another common plane. The terminal ends 18*d* of the plug-type contact elements 18 emerge or slightly project from the rear surface 30*e* of the contact supporting section 30*a*, when the contact elements 18 are fully inserted into the through holes 34 in place.

The guide wall section 30*b* includes four peripheral walls extending from the contact supporting section 30*a* slightly beyond the length of the plug contact ends 18*a* of the plug-type contact elements 18 to surround all of the contact elements 18. The guide wall section 30*b* also includes inner wall surfaces 30*c* of the peripheral walls, which serve to guide a guide wall section 24*b* of the jack-type electro-insulating body 24 under a sliding engagement between the guide wall sections 30*b*, 24*b*. The flat, major outer surface of one peripheral wall of the guide wall section 30*b*, extending along the lower row of the through holes 34, acts as a mount surface 30*d* facing a surface 16*a* of the circuit board 16 when the plug connector 10 is mounted on the board surface 16*a*. The mount surface 30*d* thus extends substantially parallel to the contact elements 18 fixedly supported in the electro-insulating body 30.

The jack-type contact elements 22 of the jack connector 12 are also prepared by stamping out a metal sheet material by a conventional press technique. Each jack-type contact element 22 has a straight, flat-plate shape, and includes the U-shaped jack contact end 22*a* adapted to be slidably engaged with the plug contact end 18*a* of each plug-type contact element 18 of the plug connector 10, a fixing portion 22*b* longitudinally adjacent to the jack contact end 22*a*, and a terminal end 22*c* longitudinally adjacent to the fixing portion 22*b* opposite to the jack contact end 22*a*.

The jack-type electro-insulating body 24 has a generally rectangular parallelepiped profile, and includes a contact supporting section 24*a* provided with a plurality of through holes 24*c* extending between the front and rear surface of the contact supporting section 24*a*, and the guide wall section 24*b* extending frontward from the neighborhood of the peripheral edge of the contact supporting section 24*a*.

The through holes 24*c* are arranged in a matrix with parallel upper and lower rows, and are positioned correspondingly to the through holes 34 of the plug-type electro-insulating body 30, i.e., in the contact pitch "$p_1$" in each row and in the pitch "$p_2$" between upper and lower rows. Each through hole 24*c* has a dimension sufficient to fix therein the fixing portion 22*b* of the jack-type contact element 22 when the fixing portion 22*b* is inserted and press-fitted into the through hole 24*c*, whereby the jack-type contact elements 22 are fixedly supported in the contact supporting section 24*a*.

The jack-type contact elements 22 are also supported in such a mutual positional relationship that the major faces of the contact elements 22 in one row are located parallel to each other in some planes, and thus are positioned at right angles with the major faces of the plug-type contact elements 18 when the jack connector 12 is connected with the plug connector 10. The terminal ends 22*c* of the jack-type contact elements 22 sufficiently project from the rear surface of the contact supporting section 24*a*, when the contact elements 22 are fully inserted into the through holes 24*c* in place.

The guide wall section 24*b* includes four peripheral walls extending from the contact supporting section 24*a* slightly beyond the length of the jack contact ends 22*a* of the jack-type contact elements 22 to surround all of the contact elements 22. The guide wall section 24*b* also includes outer wall surfaces 24*d* of the peripheral walls, which are adapted to be received and guided by the guide wall section 30*b* of the plug-type electro-insulating body 30 in a sliding engagement between the wall surfaces 24*d* and 30*c*. The rear surface of the contact supporting section 24*a* acts as a mount surface facing an electric component (not shown), on which the jack connector 12 is mounted, and the terminal ends 22*c* of the jack-type contact elements 22 are connected to signal lines provided in the electric component.

When the plug connector 10 has been properly connected with the jack connector 12 due to the interengagement between the guide wall sections 30*b* and 24*b* thereof, the plug contact ends 18*a* of the plug-type contact elements 18 are securely held within the respective slits of the U-shaped jack contact ends 22*a* of the jack-type contact elements 22 to establish and maintain a good electrical connection.

Figure 3A:
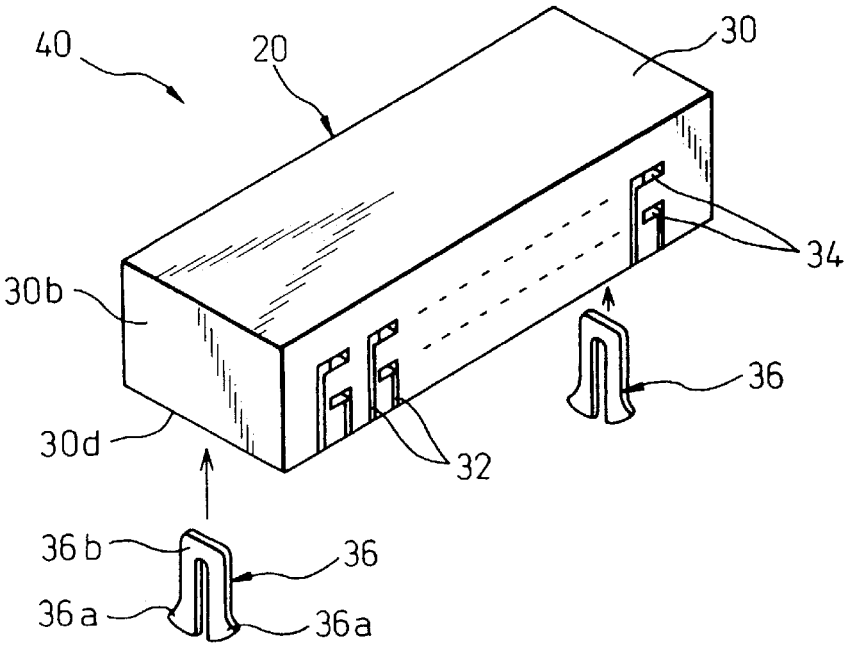
FIG. 3A is an exploded perspective view of an insulator assembly of the plug connector of FIG. 1.
Figure 3B:
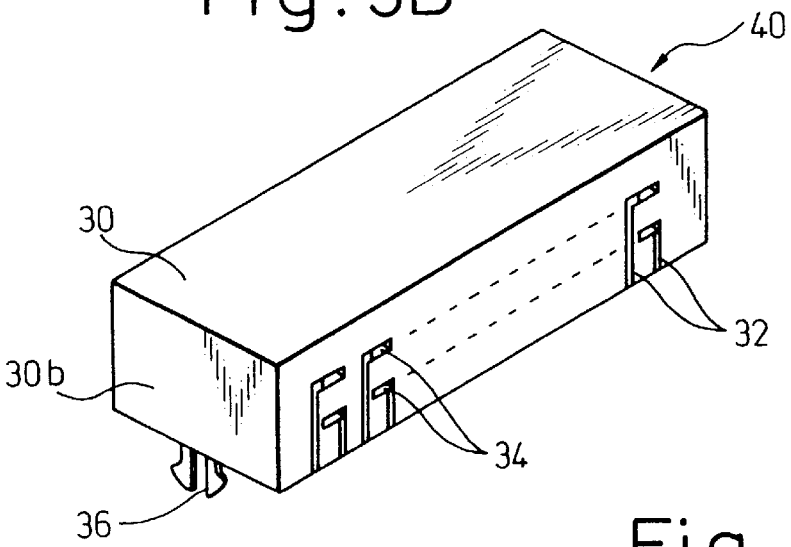
FIG. 3B is a perspective view of the insulator assembly of FIG. 3A in an assembled state.
Figure 3C:
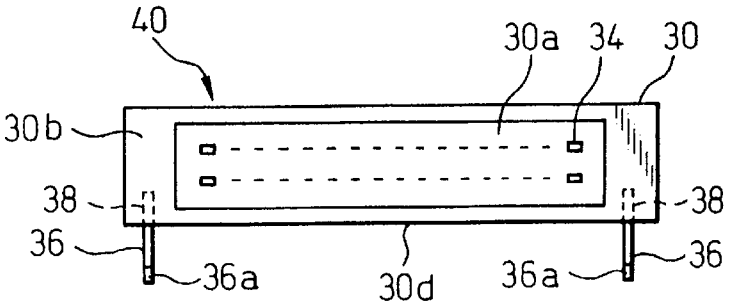
FIG. 3C is a front view of the insulator assembly of FIG. 3B.

As shown in FIGS. 3A to 3C, the plug connector 10 of this embodiment further includes a pair of board-locking members 36 respectively disposed near the longitudinally opposed edges of the mount surface 30*d* of the guide wall section 30*b* of the plug-type electro-insulating body 30. Each board-locking member 36 is prepared by stamping out a metal sheet material by a conventional press technique into a U-shaped profile having hooks 36*a* at the open end thereof.

The board-locking members 36 are inserted and press-fitted at the closed bottom end 36*b* thereof into respective grooves 38 (FIGS. 3C and 4*d*) formed in the guide wall section 30*b* of the plug-type electro-insulating body 30 in the mount surface 30*d* near the longitudinally opposed edges thereof, to provide an insulator assembly 40 of the plug connector 10. When the board-locking members 36 are fully inserted into the grooves 38 in place, the hooks 36*a* project from the mount surface 34*d* to serve as attachments of the plug connector 10 onto the surface 16*a* of the circuit board 16.

FIGS. 4A to 4D illustrate in detail the electro-insulating body 30 and plural electro-conductive paths 32 of the plug-type insulator 20 of the plug connector 10. The electro-conductive paths 32 include first terminal layers 32*a* formed to cover the inner wall surfaces 34*a* of the through holes 34 in the electro-insulating body 30, conductive lines 32*b* formed in a certain pattern on the outer surface of the electro-insulating body 30 to be electrically connected at one end thereof with the respective conductive layers 32*a*, and second terminal layers 32*c* formed in a certain array on the mount surface 30*d* to be electrically connected with the other end of the respective conductive lines 32*b*. The electro-conductive paths 32 are formed as laminas made of highly conductive metals, such as gold (Au), and are provided for the respective ones of through holes 34 separately from one another in an electrically insulated manner.

Figure 4A:
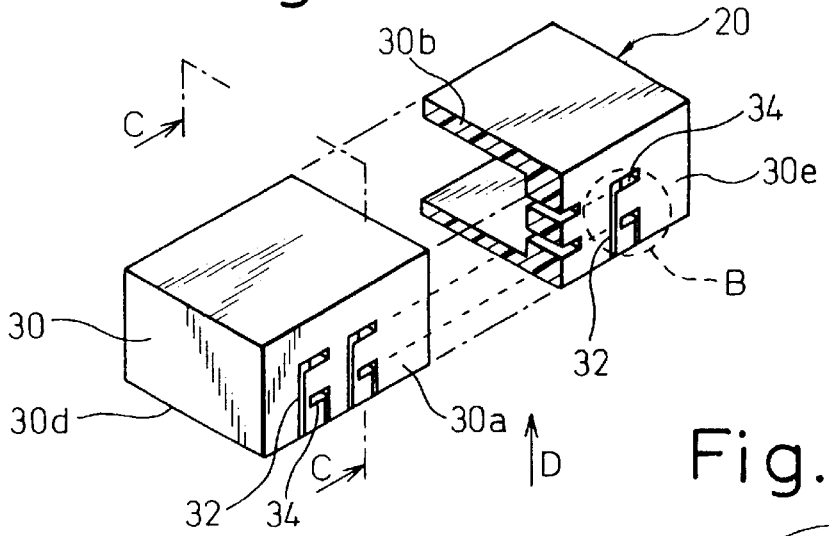
FIG. 4A is a partially cut-out perspective view of a plug-type insulator of the plug connector of FIG. 1.
Figure 4B:
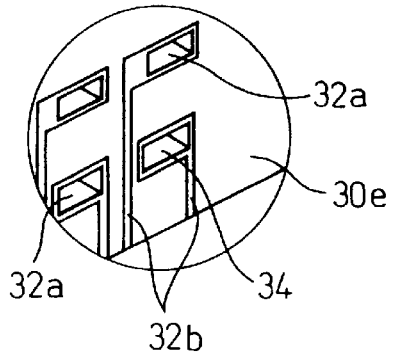
FIG. 4B is an enlarged perspective view of an encircled portion B in FIG. 4A.
Figure 4C:
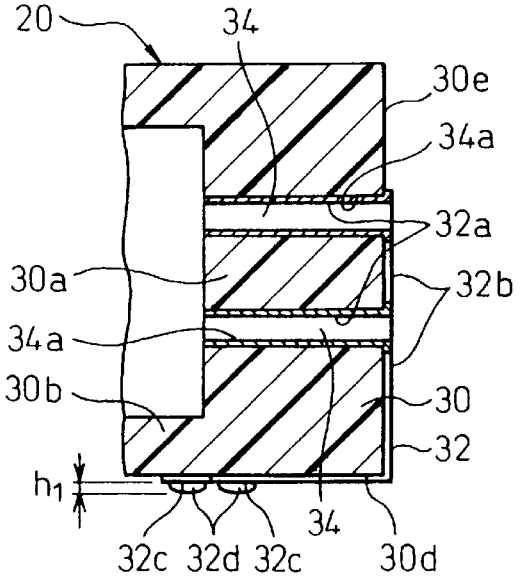
FIG. 4C is a sectional view taken along line C—C of FIG. 4A.
Figure 4D:
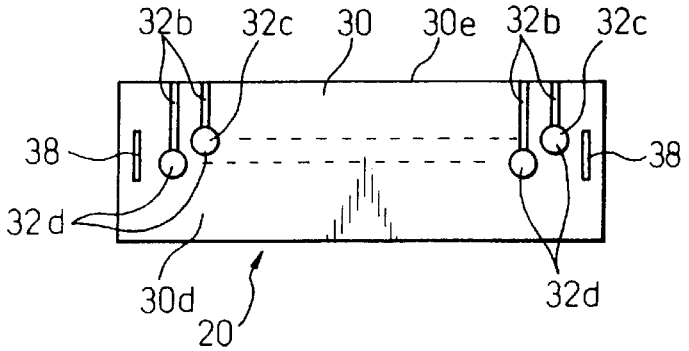
FIG. 4D is a bottom view from a direction shown by an arrow D of FIG. 4A.

As clearly shown in FIG. 4B, it is preferred that each first terminal layer 32*a* is slightly extended to the rear surface 30*e* to surround the opening edge of the through hole 34, to ensure the durability of the electrical connection between the first terminal layer 32*a* and the corresponding conductive line 32*b*. Each conductive line 32*b* continuously extends on the rear surface 30*e* of the contact supporting section 30*a* and the mount surface 30*d* of the guide wall section 30*b*.

The second terminal layers 32*c* are provided as external terminals of the connector 10, which are adapted to be electrically connected with the circuit of the circuit board 16. In this embodiment, the external terminals include solder bumps 32*d* provided on the respective second terminal layers 32*c* so as to bulge from the terminal layers 32*c* at a height "$h_1$". The second terminal layers 32*c* or solder bumps 32*d* are preferably disposed in a staggered manner on the mount surface 30*d* to increase the insulation distance between the adjacent terminal layers 32*c* or solder bumps 32*d*. The solder bumps 32*d* are arranged generally along the longitudinal center line of the mount surface 30*d*, and the grooves 38 mentioned above are disposed outside the longitudinally opposed ends of the bump forming area on the mount surface 30*d*.

Figure 5A:
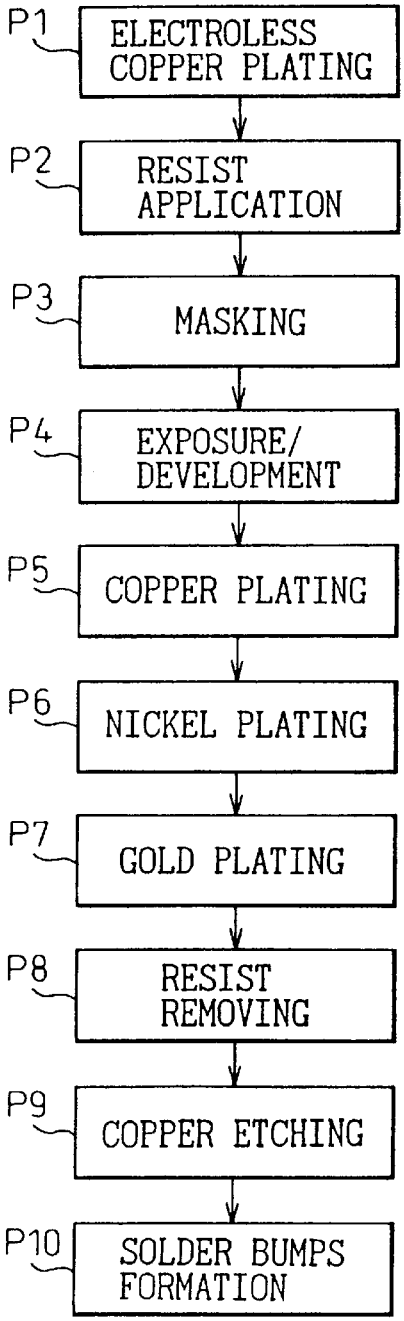
FIG. 5A is a flow chart showing the steps of forming electro-conductive paths of the plug connector of FIG. 1.
Figure 5B:
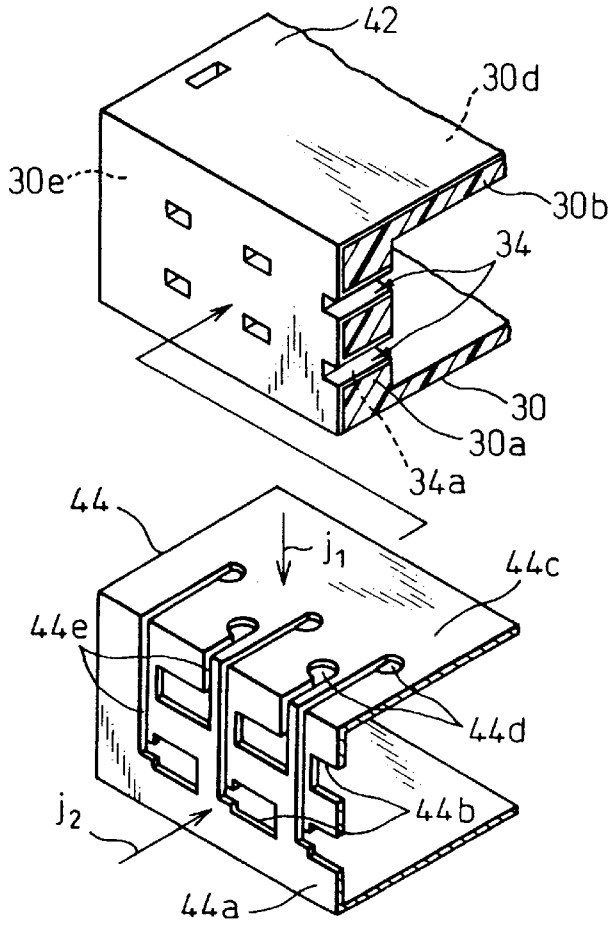
FIG. 5B is an enlarged perspective view of a part of the plug connector of FIG. 1, showing one step of the flow chart of FIG. 5A.
Figure 5C:
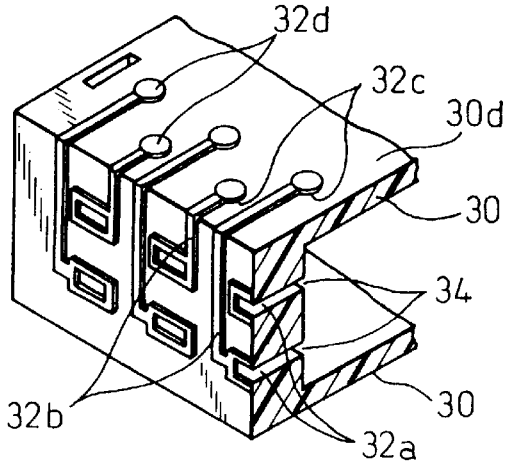
FIG. 5C is an enlarged perspective view of a part of the plug connector of FIG. 1, showing a final step of the flow chart of FIG. 5A.

FIGS. 5A to 5C illustrate one example of the process for forming the electro-conductive paths 32 on the surface of the electro-insulating body 30 of the plug connector 10. In the first step P1 (FIG. 5A), a copper plate layer 42 having a predetermined thickness is formed on the entire surface of the electro-insulating body 30 through a conventional electroless copper plating method. In this method, the copper plate layer 42 is also formed on the inner wall surfaces 34*a* of the through holes 34 in the contact supporting section 30*a* of the electro-insulating body 30. Then, a resist is applied on the entire surface of the copper plate layer 42 (step P2).

In step P3, a masking member 44 is fitted onto the plated electro-insulating body 30, as shown by an arrow, to mask the desired area of the copper plate layer 42 applied with the resist. The masking member 44 may be formed by bending a metal plate into a box shape having dimensions enabling the masking member 44 to cover the outer peripheral surface of the electro-insulating body 30, including the mount surface 30*d* and the rear surface 30*e* thereof.

The rear section 44*a* of the masking member 44, for covering the rear surface 30*e*, is provided with a plurality of first openings 44*b* located correspondingly to the through holes 34, each first opening 44*b* having a dimension slightly larger than the dimension of the opening area of each through hole 34. The bottom section 44*c* of the masking member 44, for covering the mount surface 30*d*, is provided with a plurality of second openings 44*d* arranged in a staggered manner, the number of which is identical to the number of the first openings 44*b*. A plurality of slits or third openings 44*e* are formed through the rear and bottom section 44*a*, 44*c* and respectively extend between the first and second openings 44*b*, 44*d* to connect the corresponding openings 44*b*, 44*d* with each other. The slits 44*e* are located with a suitable distance therebetween. That is, one opening area formed by the corresponding first opening 44*b*, second opening 44*d* and slit 44*e* is separated from the other opening area.

Next, in step P4, the resist is exposed and developed in the desired portions thereof, where the electro-conductive paths 32 will be formed, and which are defined by the plural opening areas including the corresponding first openings 44*b*, second openings 44*d* and slits 44*e* of the masking member 44, through a conventional photolithographic method, to remove the desired portions of the resist. In this exposing step, the light is irradiated onto the rear and bottom sections 44*a*, 44*c* of the masking member 44 in the directions shown by arrows "j1" and "j2" in FIG. 5B. It will be appreciated that the portions of the resist, which are applied on the copper plate layer 42 formed on the inner wall surfaces 34*a* of the through holes 34, are also removed in step P4. Consequently, the through holes 34 with the copper plate layer 42 being formed on the inner wall surface 34*a* thereof are provided.

Then, copper plate layers having predetermined thickness (step P5), nickel plate layers having predetermined thickness (step P6) and gold plate layers having predetermined thickness (step P7) are sequentially formed through a conventional electroplating method on the exposed portions of the electroless copper plate layer 42.

Next, in step P8, the residual resist is fully stripped or removed, and in step P9, the finally exposed portion of the electroless copper plate layer 42 is removed by etching. As a result, the electro-conductive paths 32 are provided, each of which is structured by the first terminal layer 32*a* formed on the inner wall surface 34*a* of the through hole 34, corresponding to the first opening 44*b* of the masking member 44, the conductive line 32*b* formed on the outer surface of the electro-insulating body 30, corresponding to the slit 44*e* of the masking member 44, to be connected at one end thereof with the first terminal layer 32*a*, and the second terminal layer 32*c* formed on the mount surface 30*d*, corresponding to the second opening 44*d* of the masking member 44, to be connected with the other end of the conductive line 32*b*.

In the final step P10, the solder bumps 32*d* are formed on the second terminal layers 32*c* of the electro-conductive paths 32. In this step, for example, solder balls (not shown) having suitable sizes are put on the second terminal layers 32*c* and are melted and solidified through a conventional reflow soldering process to provide the solder bumps 32*d*. Consequently, the plug-type insulator 20 of the plug connector 10, as shown in FIGS. 4A to 4D, is provided.

Figure 6:
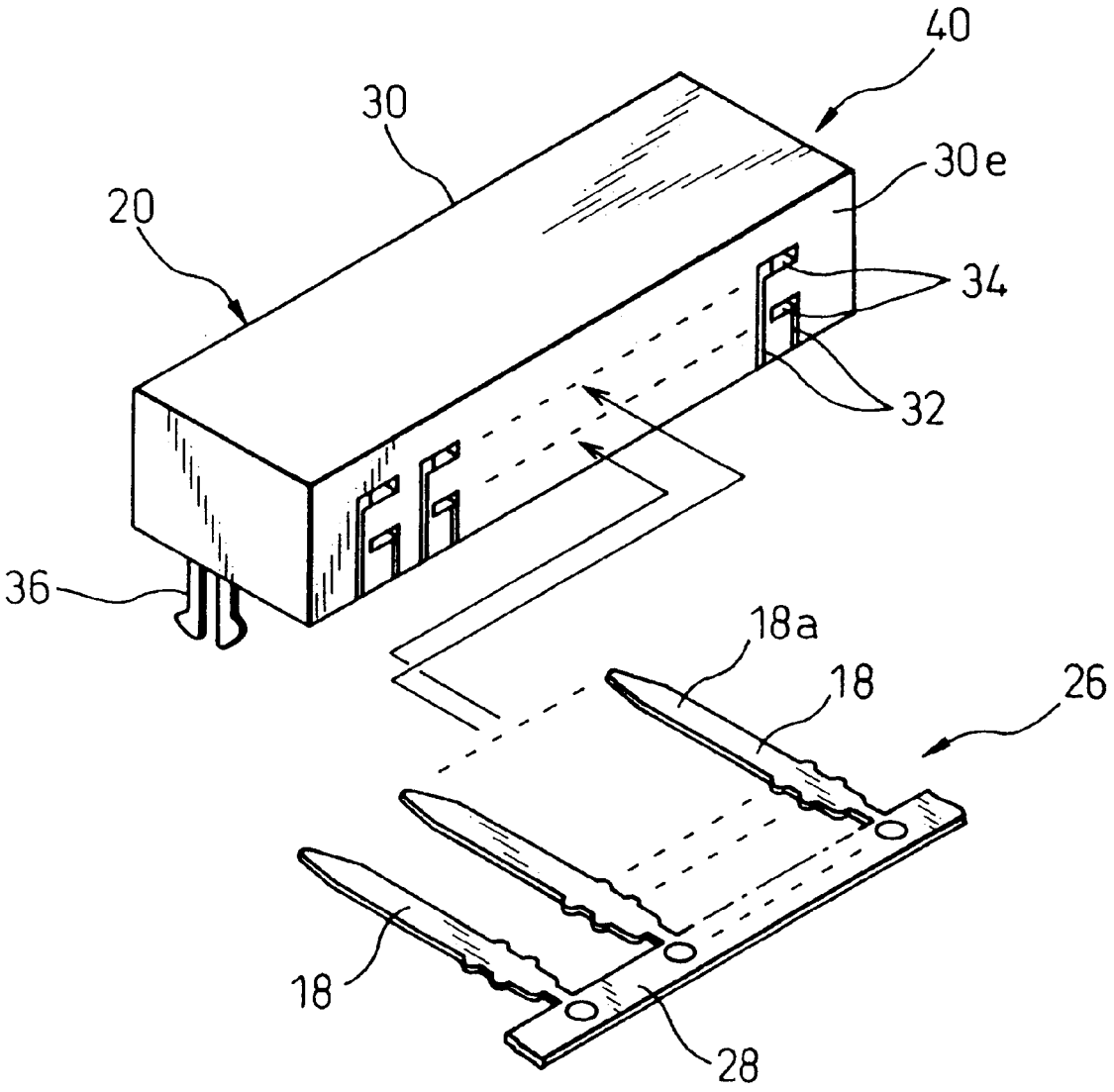
FIG. 6 is a perspective view of the plug connector of FIG. 1, showing a step of inserting the contact elements into the insulator assembly.

The board-locking members 36 are incorporated in the plug-type insulator 20 thus formed, to provide the insulator assembly 40 as mentioned above. Then, as shown in FIG. 6, the contact elements 18 are inserted and press-fitted into the through holes 34 as the blank 26 wherein the contact elements 18 are joined together by the joint member 28, with the plug contact end 18*a* being first inserted from the rear surface 30*e* of the electro-insulating body 30. In this case, two blanks 26 are press-fitted into the respective upper and lower rows of the through holes 34, as shown by arrows. When the blanks 26 are securely held in the through holes, the joint members 28 of the respective blanks 26 are cut and removed. Whereby, the plug connector 10 shown in FIG. 1 is provided, in which the contact elements 18 are fixedly supported in the contact supporting section 30*a* of the electro-insulating body 30 with the aid of the bulges 18*c*, and are electrically connected through the first terminal layers 32*a* and the conductive lines 32*b* to the second terminal layers 32*c* or solder bumps 32*d* as external terminals.

Referring again to FIG. 1, the circuit board 16, on which the plug connector 10 is mounted, is provided at the area adjacent to one edge 16*b* thereof with a plurality of terminal holes 16*c* connected with a circuit (not shown) formed in the circuit board 16. The terminal holes 16*c* are positioned on the surface 16*a* of the circuit board 16 correspondingly to the solder bumps 32*d* of the plug connector 10, and each terminal hole 16*c* has dimensions enabling the solder bump 32*d* to be suitably received on the opening edge of the terminal hole 16*c*. The circuit board 16 is also provided with a pair of mount holes 16*d* located on the surface 16*a* of the circuit board 16 correspondingly to the board-locking members 36 of the plug connector 10, to receive the board-locking members 36.

The plug connector 10 may be mounted onto the circuit board 16, as shown by arrows in FIG. 1, by using any mounting devices such as a vacuum nozzle 46. When the board-locking members 36 of the plug connector 10 are suitably received in the mount holes 16*d* and securely engaged therewith, the plug connector 10 is properly positioned on the circuit board 16, and the solder bumps 32*d* are properly received in the terminal holes 16*c*. In this way, it is possible to ease the mounting operation of the plug connector 10 including the subsequent reflow soldering or heating process, etc.

The plug connector 10 of this embodiment possesses various exceptional and advantageous effects as follows. The plug connector 10 uses only one type of the contact elements 18 even if the plural rows of the contact elements 18 are arranged in the plug-type insulator 20. Also, since the second terminal layers 32*c* or external terminals, electrically connected to the contact elements 18, are disposed on the common mount surface 30*d* of the electro-insulating body 30, the adjustment of the height of the external terminals, sometimes required in the conventional connector, is not required. Accordingly, the productivity of the plug connector 10 can be improved.

Also, in the plug connector 10, since the second terminal layers 32*c* or external terminals are disposed on the mount surface 30*d* of the electro-insulating body 30, the circuit board 16 provides for the connector 10 only the mounting area 16*e* (FIG. 1) on the surface 16*a* thereof and the terminal holes 16*c* can be arranged within the mounting area 16*e*. Therefore, it is possible to increase the area for mounting the other electric devices on the surface 16*a*, and thus to facilitate the high density mounting performance of the circuit board 16.

Further, the second terminal layers 32*c* or external terminals can be located at various positions on the mount surface 30*d* of the electro-insulating body 30 by selecting the pattern of the conductive lines 32*b*. Therefore, it is possible to easily increase the distance between the adjacent second terminal layers 32*c* or solder bumps 32*d*, and also to enlarge the second terminal layers 32*c* or solder bumps 32*d*. Accordingly, even if the connector 10 includes the high density array of the contact elements 18, the connector 18 can be properly mounted on the surface 16*a* of the circuit board 16 without the risk of short circuit of the adjacent terminals 32*c* or bumps 32*d*.

Moreover, when the solder bumps 32*d* are enlarged to increase the height thereof, the deformation or deflection of the circuit board 16 or the electro-insulating body 30 is absorbed due to the thermal deformation of the solder bumps 32*d* by heat applied in the mounting process, which ensures the proper electrical connection between the connector 10 and the circuit board 16.

Figure 7A:
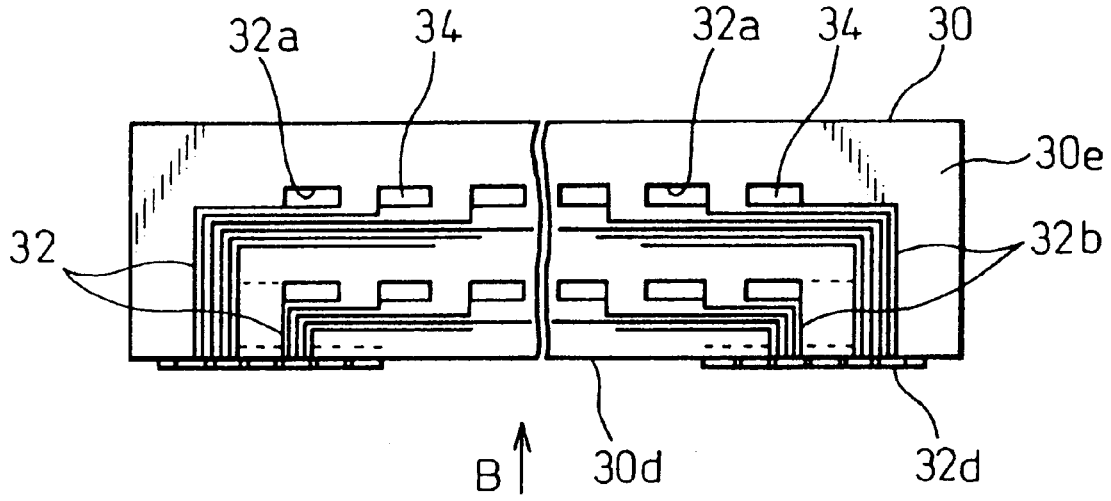
FIG. 7A is a rear view of an insulator assembly including a modification of the electro-conductive paths of the plug connector of FIG. 1.
Figure 7B:
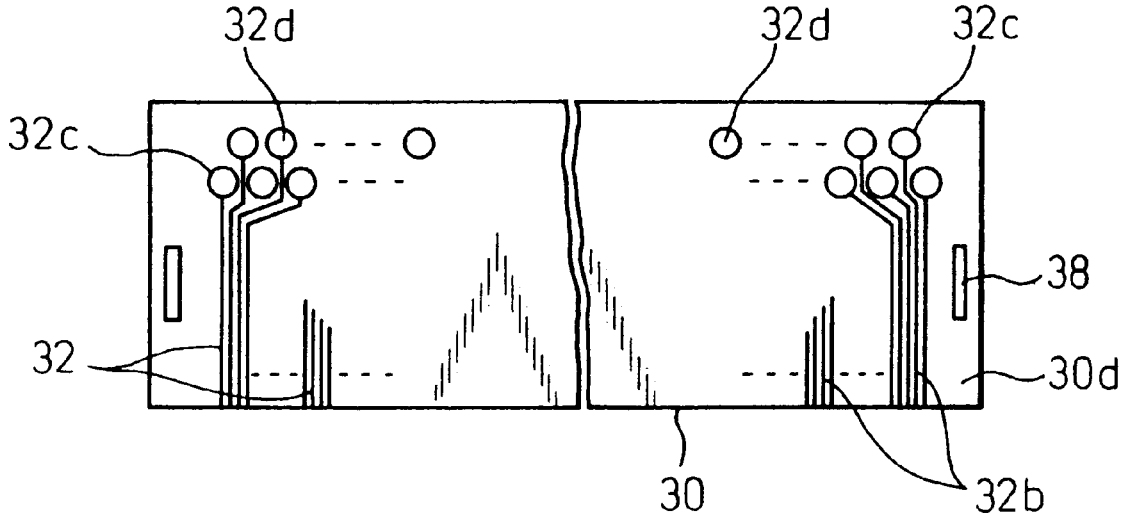
FIG. 7B is a bottom view from a direction shown by an arrow B of FIG. 7A.

FIGS. 7A and 7B show one modification of the pattern of the electro-conductive paths 32 in the plug connector 10. The electro-conductive paths 32 in this modification include the first terminal layers 32*a* formed on the inner wall surfaces of the through holes 34 in the electro-insulating body 30, conductive lines 32*b* formed on the outer surface of the electro-insulating body 30 to be electrically connected at one end thereof with the respective first terminal layers 32*a*, and second terminal layers 32*c* or external terminals formed on the mount surface 30*d* to be electrically connected with the other end of the respective conductive lines 32*b*.

The conductive lines 32*b* for the upper row of through holes 34 are divided into two groups and gathered in each group in the longitudinal end region of the upper row defined outside the lower row of through holes 34 on the rear surface 30*e* of the contact supporting section 30*a*, and extend on the mount surface 30*d* accordingly. The conductive lines 32*b* for the lower row of through holes 34 are also divided into two groups and gathered in each group on the longitudinal end region of the lower row defined inside the conductive lines 32*b* for the upper row, and extend on the mount surface 30*d* accordingly. The second terminal layers 32*c* of the, electro-conductive paths 32 are grouped together in two local areas on the mount surface 30*d*, as shown in FIG. 7B. The second terminal layers 32*c* may preferably be arranged in a staggered manner to increase the insulation distance between the adjacent terminals 2*c*. The solder bumps 32*d* are also provided on the respective second terminal layers 32*c*.

The above modified electro-conductive paths 32 may be formed by the same steps as those described with reference to FIGS. 5A to 5C. In this modification, since the second terminal layers 32*c* of the electro-conductive paths 32 are grouped together in the local areas, it is possible to further increase the area for forming the circuit on the surface 16*a* of the circuit board 16, and thus to improve the productivity of the circuit board 16.

It will be appreciated that the board-mount connector according to the present invention is not limited to the above embodiment but may be variously embodied as described below.

Figure 8:
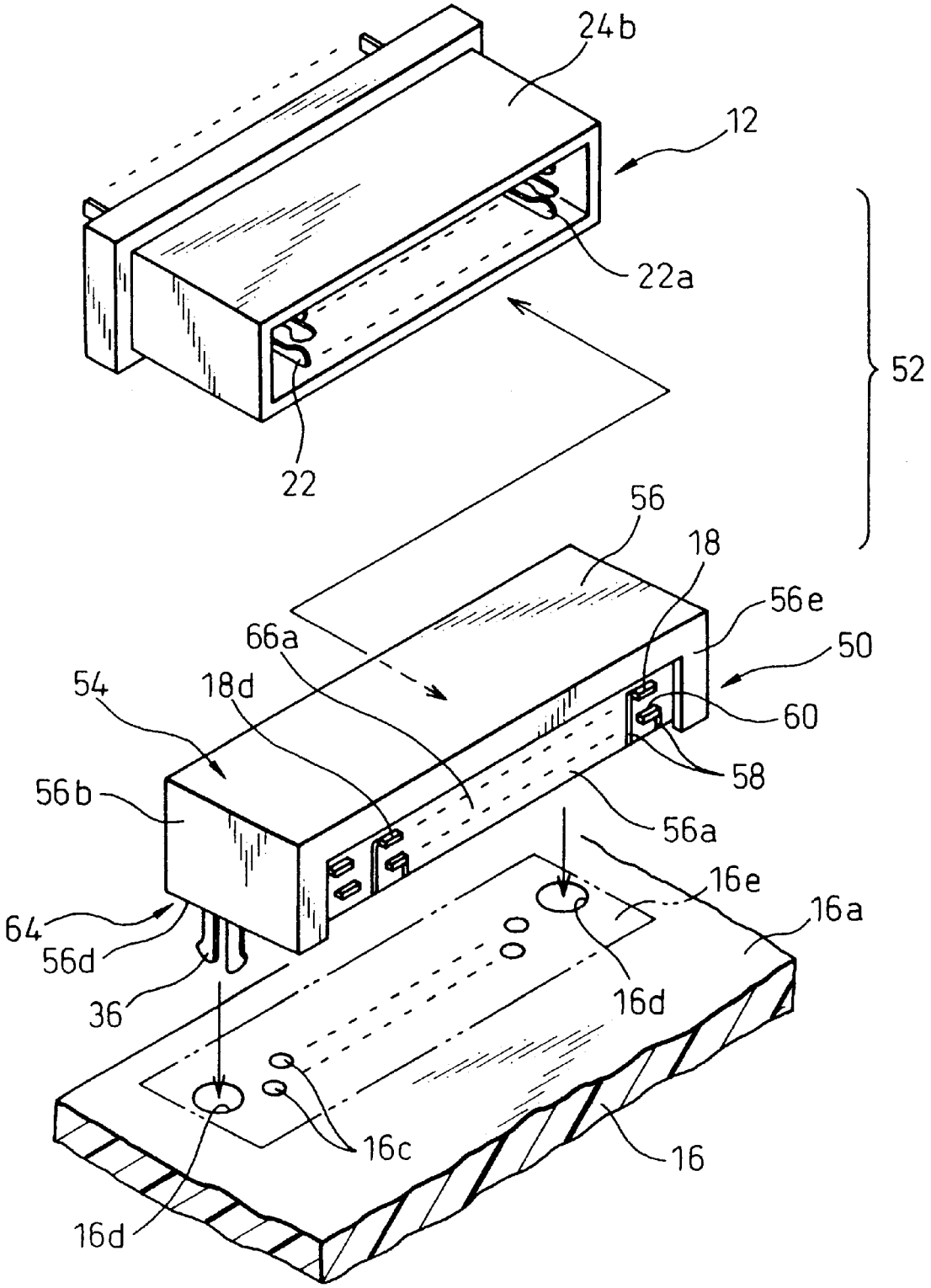
FIG. 8 is a perspective view of a plug connector according to the second embodiment of the present invention, together with a counterpart jack connector and a circuit board.

FIG. 8 shows a surface-mount type plug connector 50 as a second embodiment of a board-mount connector according to the present invention. The plug connector 50 is adapted to be detachably connected to the jack connector 12 described in relation to the first embodiment, as shown by an arrow, to provide a connector system 52 which is suitably used for connection between a circuit board 16 and another electrical component (not shown).

The plug connector 50 of the second embodiment has a structure generally similar to that of the plug connector 10 of the first embodiment with the exception of the features of a plug-type insulator 54 described below. The same or similar components in both embodiments are designated by common reference numerals, and the detailed description thereof need not be repeated.

The plug connector 50 includes a plurality of plug-type contact element 18 and a plug-type insulator 54 securely holding therein the contact elements 18 in a mutually insulated arrangement. The plural contact elements 18 are arranged parallel to each other in a matrix with two upper and lower rows, in the same way as described in the plug connector 10.

The plug-type insulator 54 includes a plug-type electro-insulating body 56, and a plurality of electro-conductive paths 58 formed on the surface of the electro-insulating body 56 in substantially the same way as the electro-conductive paths 32 in the plug connector 10. The plug-type electro-insulating body 56 has a generally rectangular parallelepiped profile, and includes a contact supporting section 56*a* provided with a plurality of through holes 60 extending between the front and rear surface of the contact supporting section 56*a*, and a guide wall section 56*b* extending frontward from the peripheral edge area of the contact supporting section 56*a*.

The through holes 60 are arranged in a matrix with parallel upper and lower rows, in substantially the same way as the through holes 34 in the plug connector 10. Each through hole 60 has dimensions sufficient to fix therein the fixing portion 18*b* (FIG. 2B) of the plug-type contact element 18 when the fixing portion 18*b* is inserted and press-fitted into the through hole 60, whereby the contact elements 18 are fixedly supported in parallel with each other in the contact supporting section 56*a*.

The guide wall section 56*b* is similar to the guide wall section 30*b* in the plug connector 10, and includes four peripheral walls serving to guide a guide wall section 24*b* of the jack connector 12. The flat, major outer surface of one peripheral wall of the guide wall section 56*b*, extending along the lower row of the through holes 60, acts as a mount surface 56*d* facing a surface 16*a* of the circuit board 16 when the plug connector 50 is mounted on the board surface 16*a*. The mount surface 56*d* thus extends substantially parallel to the contact elements 18 fixedly supported in the electro-insulating body 56.

The plug connector 50 of the second embodiment further includes a pair of board-locking members 36 respectively disposed near the longitudinally opposed edges of the mount surface 56*d* of the electro-insulating body 56. The board-locking members 36 are inserted and press-fitted into respective grooves 62 (FIG. 9C) formed in the guide wall section 56*b* of the electro-insulating body 56 in the mount surface 56*d* near the longitudinally opposed edges thereof, to provide an insulator assembly 64 of the plug connector 50, and serve as attachments of the plug connector 50 onto the surface 16*a* of the circuit board 16.

Figure 9A:
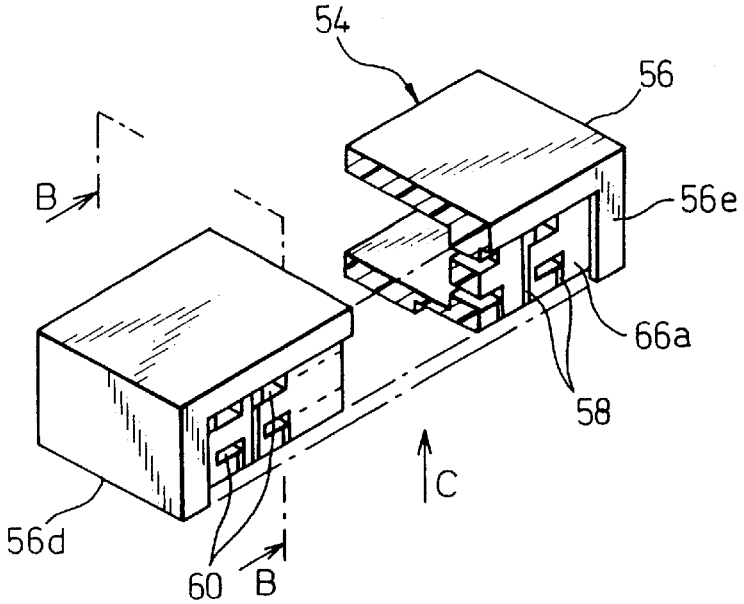
FIG. 9A is a partially cut-out perspective view of a plug-type insulator of the plug connector of FIG. 8.
Figure 9B:
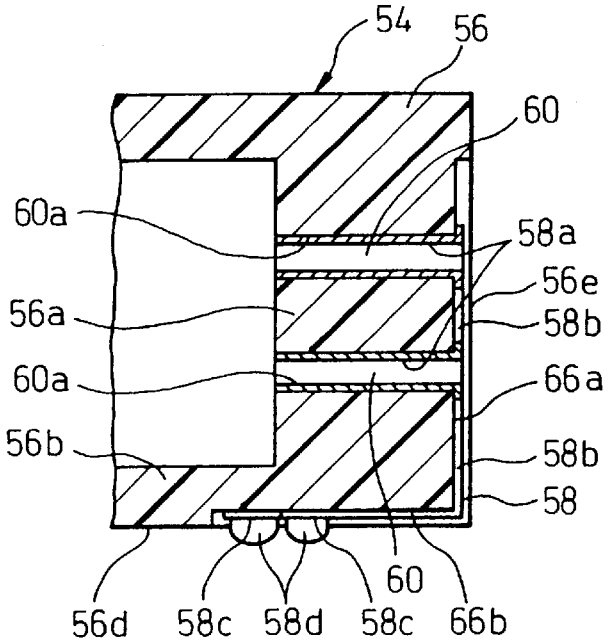
FIG. 9B is a sectional view taken along line B—B of FIG. 9A.
Figure 9C:
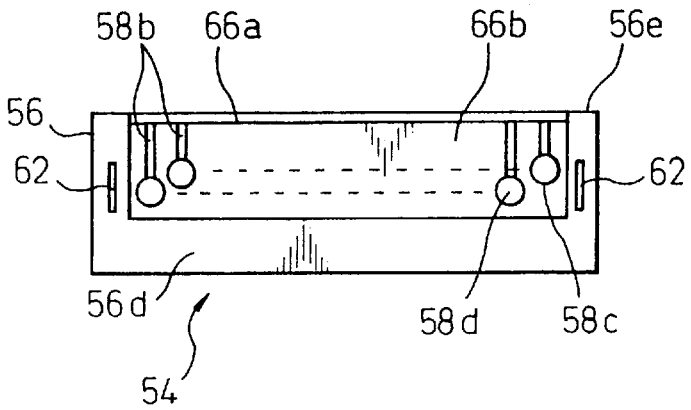
FIG. 9C is a bottom view from a direction shown by an arrow C of FIG. 9A.

FIGS. 9A to 9C illustrate in detail the electro-insulating body 56 and plural electro-conductive paths 58 of the plug connector 50. The electro-insulating body 56 is provided with recessed portions 66*a* and 66*b* defined in the rear surface 56*e* and the mount surface 56*d* thereof, respectively. The recessed portion 66*a* extends to a certain area of the rear surface 56*e* to which all of the through holes 60 open, and the recessed portion 66*b* extends to a certain area of the mount surface 56*d* adjacent to the rear surface 56*e* to communicate with the recessed portion 66*a* with no projection therebetween.

The electro-conductive paths 58 include first terminal layers 58*a* formed to cover the inner wall surfaces 60*a* of the through holes 60 in the electro-insulating body 56, conductive lines 58*b* formed in a certain pattern on the surface in the recessed portions 66*a*, 66*b* to be electrically connected at one end thereof with the respective first terminal layers 58*a*, and second terminal layers 58*c* formed in a certain array on the surface in the recessed portion 66*b* to be electrically connected with the other end of the respective conductive lines 58*b*. The electro-conductive paths 58 are formed as laminas made of highly conductive metals, such as gold (Au), and are provided for the respective ones of through holes 60 separately from one another in an electrically insulated manner.

Each conductive line 58*b* continuously extends over the recessed portions 66*a*, 66*b*. The second terminal layers 58*c* are provided as external terminals of the connector 50, which are adapted to be electrically connected with the circuit of the circuit board 16. In this embodiment, the external terminals include solder bumps 58*d* provided on the respective second terminal layers 58*c* so as to partially protrude from the mount surface 56*d*. The second terminal layers 58*c* or solder bumps 58*d* are preferably disposed in a staggered manner in the recessed portion 66*b* to increase the insulation distance between the adjacent terminal layers 58*c* or solder bumps 58*d*.

The electro-conducive paths 58 of the plug connector 50 may be formed through the same steps as those described in the first embodiment with reference to FIGS. 5A to 5C. It should be noted that a masking member (not shown) used in the second embodiment for forming the electro-conductive paths 58 is structured as a modification of the masking member 44 (FIG. 5B), wherein stepped portions corresponding to the recessed portions 66*a*, 66*b* are formed in the rear and bottom section 44*a*, 44*c*.

The board-locking members 36 are incorporated in the plug-type insulator 54 thus formed, to provide the insulator assembly 64 as mentioned above. Then, the contact elements 18 are press-fitted into the through holes 60 and fixedly supported in the plug-type insulator 54, in the same way as described in the first embodiment. Whereby, the plug connector 50 shown in FIG. 8 is provided, in which the contact elements 18 are electrically connected through the first terminal layers 58*a* and the conductive lines 58*b* to the second terminal layers 58*c* or solder bumps 58*d* as external terminals. Also, the plug connector 50 can be easily mounted in a proper position on the circuit board 16, as shown by arrows in FIG. 8, in the same way as described in the first embodiment.

The plug connector 50 of the second embodiment possesses various exceptional and advantageous effects generally identical to those described in relation to the plug connector 10 of the first embodiment. Especially in the plug connector 50, since the electro-conductive paths 58 are formed in the recessed portions 66*a*, 66*b* in the rear and mount surfaces 56*e*, 56*d* of the electro-insulating body 56, it is possible to effectively prevent the electro-conductive paths 58 from being damaged due to accidental external force. If the recessed portions 66*a*, 66*b* are covered or filled by, e.g., resinous materials, the electro-conductive paths 58, as well as the terminal ends 18*d* of the contact elements 18, can also be protected from the environmental atmosphere.

Figure 10:
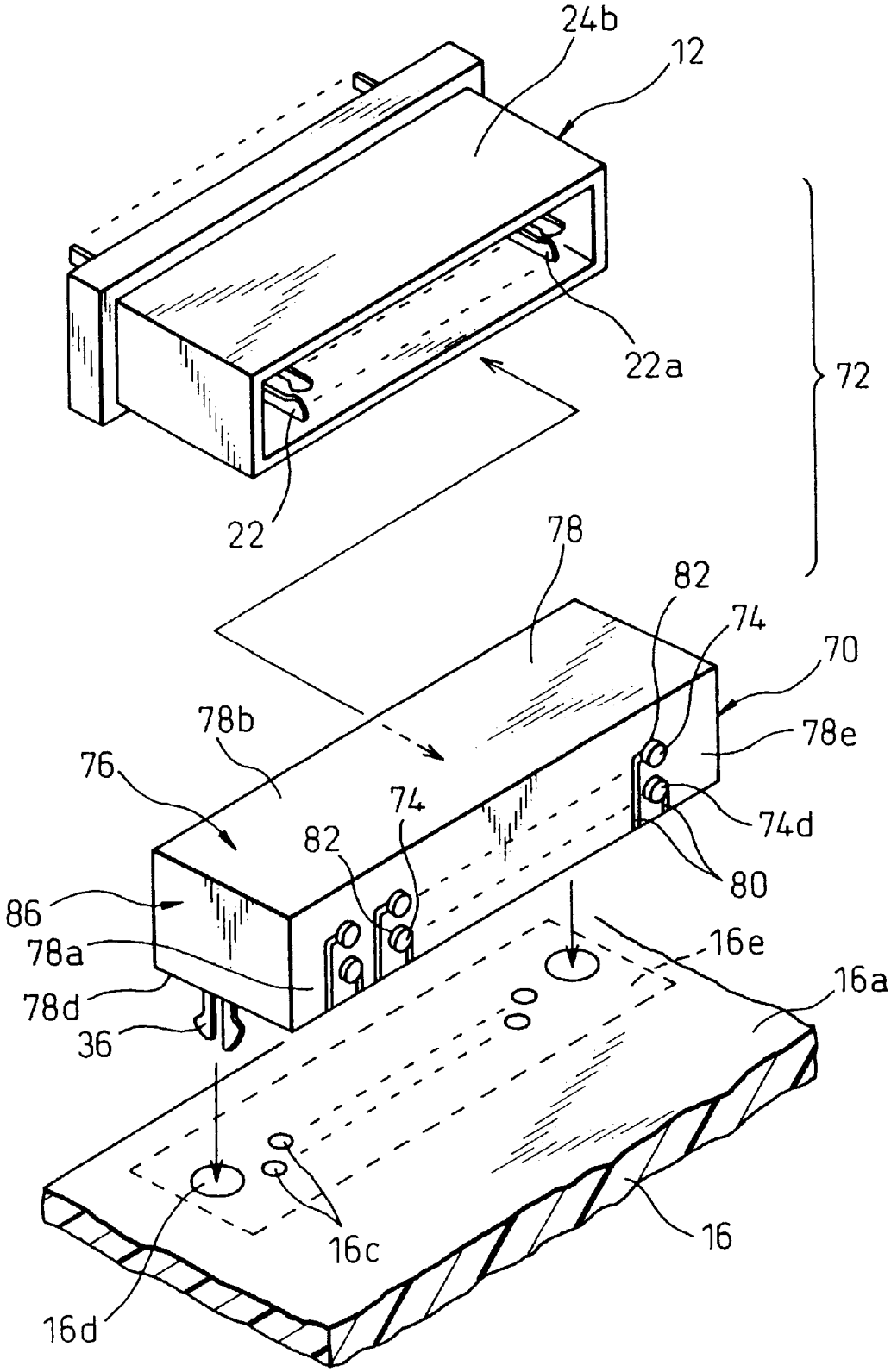
FIG. 10 is a perspective view of a plug connector according to the third embodiment of the present invention, together with a counterpart jack connector and a circuit board.

FIG. 10 shows a surface-mount type plug connector 70 as a third embodiment of a board-mount connector according to the present invention. The plug connector 70 is adapted to be detachably connected to the jack connector 12 described in relation to the first embodiment, as shown by an arrow, to provide a connector system 72 which is suitably used for connection between a circuit board 16 and another electrical component (not shown).

The plug connector 70 of the third embodiment has a structure generally similar to that of the plug connector 10 of the first embodiment with the exception of the features of a plurality of contact elements 74 and a plug-type insulator 76 described below. The same or similar components in both embodiments are designated by common reference numerals, and the detailed description thereof need not be repeated.

The plug connector 70 includes a plurality of plug-type contact elements 74 and a plug-type insulator 76 securely holding therein the contact elements 74 in a mutually insulated arrangement. The plural contact elements 74 are arranged parallel to each other in a matrix with two upper and lower rows, in substantially the same way as in the plug connector 10.

Figure 11:
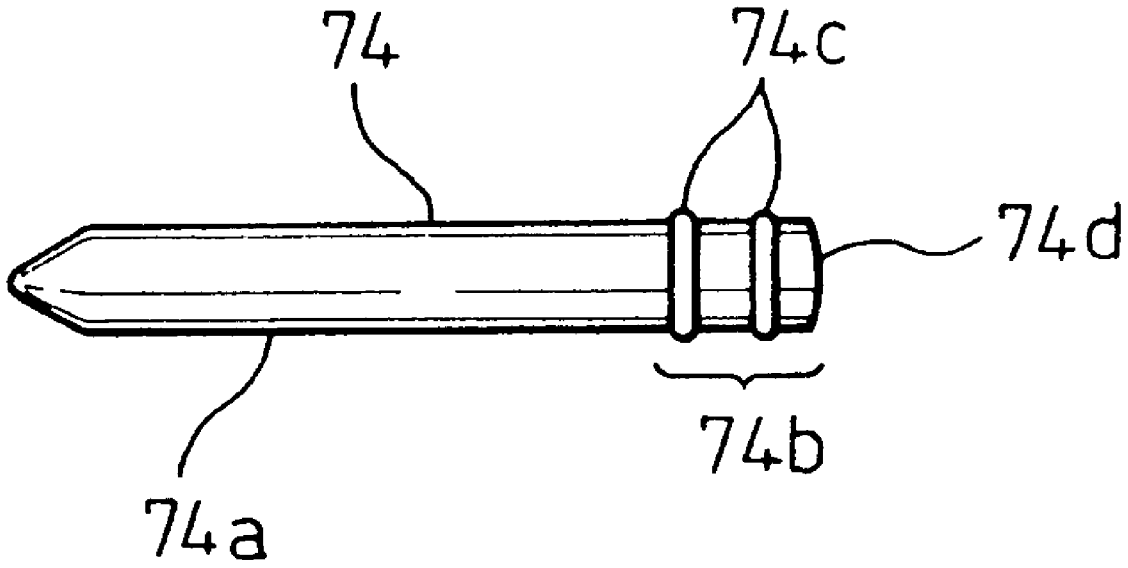
FIG. 11 is a front view of a contact element used in the plug connector of FIG. 10.

As shown in FIG. 11, each plug-type contact element 74 has a straight, cylindrical shape, and includes a plug contact end 74*a* adapted to be in a sliding engagement with a jack contact end 22*a* of each counterpart jack-type contact element 22 of the jack connector 12, a fixing portion 74*b* longitudinally adjacent to the plug contact end 74*a* and provided with bulges 74*c* protruding circumferentially from the outer surface of he contact element 74, and a terminal end 74*d* longitudinally adjacent to the fixing portion 74*b* opposite to the plug contact end 74*a*. It should be noted that the jack contact end 22*a* of the jack-type contact element 22 may be modified in shape to be suitably engageable with the cylindrical plug contact end 74*a* of the plug-type contact element 74.

Referring again to FIG. 10, the plug-type insulator 76 includes a plug-type electro-insulating body 78, and a plurality of electro-conductive paths 80 formed on the surface of the electro-insulating body 78 in substantially the same way as the electro-conductive paths 32 in the plug connector 10. The plug-type electro-insulating body 78 has a generally rectangular parallelepiped profile, and includes a contact supporting section 78*a* provided with a plurality of through holes 82 extending between the front and rear surface of the contact supporting section 78*a*, and a guide wall section 78*b* extending frontward from the peripheral edge area of the contact supporting section 78*a*.

The through holes 82 are arranged in a matrix with parallel upper and lower rows, in substantially the same way as the through holes 34 in the plug connector 10. Each through hole 82 has a generally cylindrical cross section and dimensions sufficient to fix therein the fixing portion 74*b* of the plug-type contact element 74 when the fixing portion 74*b* is inserted and press-fitted into the through hole 82, whereby the contact elements 74 are fixedly supported in parallel with each other in the contact supporting section 78*a*.

The guide wall section 78*b* is similar to the guide wall section 30*b* in the plug connector 10, and includes four peripheral walls serving to guide the guide wall section 24*b* of the jack connector 12. The flat, major outer surface of one peripheral wall of the guide wall section 78*b*, extending along the lower row of the through holes 82, acts as a mount surface 78*d* facing the surface 16*a* of the circuit board 16 when the plug connector 70 is mounted on the board surface 16*a*. The mount surface 78*d* thus extends substantially parallel to the contact elements 74 fixedly supported in the electro-insulating body 78.

The plug connector 70 of the third embodiment further includes a pair of board-locking members 36 respectively disposed near the longitudinally opposed edges of the mount surface 78*d* of the electro-insulating body 78. The board-locking members 36 are inserted and press-fitted into respective grooves 84 (FIG. 12D) formed in the guide wall section 78*b* of the electro-insulating body 78 in the mount surface 78*d* near the longitudinally opposed edges thereof, to provide an insulator assembly 86 of the plug connector 70, and serve as attachments of the plug connector 70 onto the surface 16*a* of the circuit board 16.

FIGS. 12A to 12D illustrate in detail the electro-insulating body 78 and plural electro-conductive paths 80 of the plug-type insulator 76 of the plug connector 70. The electro-conductive paths 80 include first terminal layers 80*a* formed to cover the cylindrical inner wall surfaces 82*a* of the through holes 82 in the electro-insulating body 78, conductive lines 80*b* formed in a certain pattern on the outer surface of the electro-insulating body 78 to be electrically connected at one end thereof with the respective first terminal layers 80*a*, and second terminal layers 80*c* formed in a certain array on the mount surfaces 78*d* to be electrically connected with the other end of the respective conductive lines 80*b*. The electro-conductive paths 80 are formed as laminas made of highly conductive metals, such as gold (Au), and are provided for the respective ones of through holes 82 separately from one another in an electrically insulated manner.

Figure 12A:
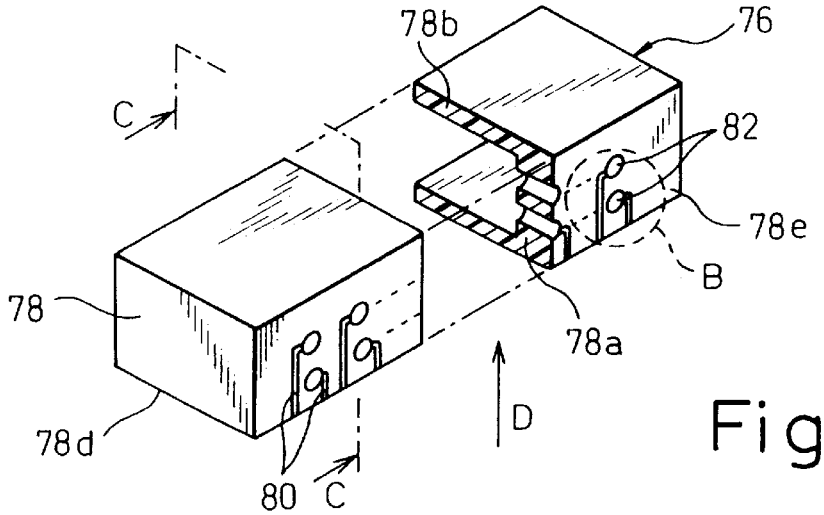
FIG. 12A is a partially cut-out perspective view of a plug-type insulator of the plug connector of FIG. 10.
Figure 12B:
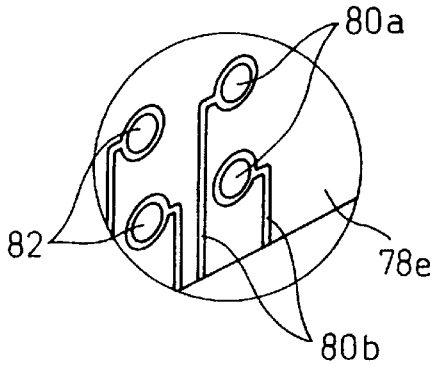
FIG. 12B is an enlarged perspective view of an encircled portion B in FIG. 12A.
Figure 12C:
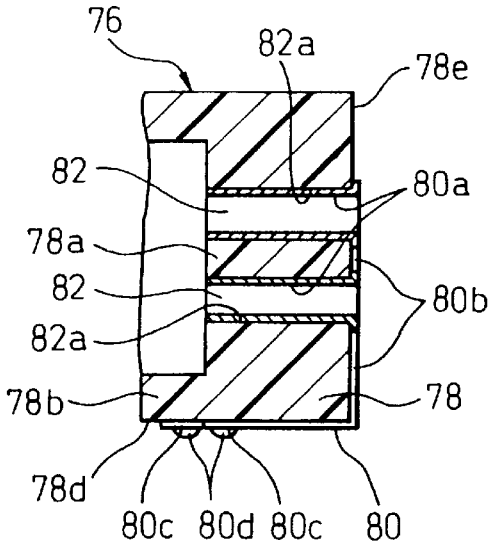
FIG. 12C is a sectional view taken along line C—C of FIG. 12A.
Figure 12D:
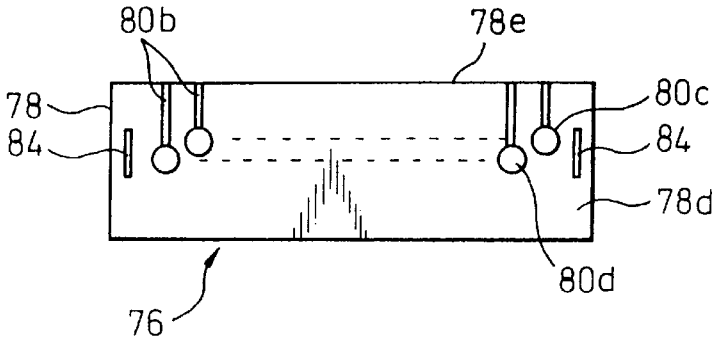
FIG. 12D is a bottom view from a direction shown by an arrow D of FIG. 12A.

As clearly shown in FIG. 12B, it is preferred that each first terminal layer 80*a* is slightly extended to the rear surface 78*e* to surround the opening edge of the through hole 82, to ensure the durability of the electrical connection between the first terminal layer 80*a* and the corresponding conductive line 80*b*. Each conductive line 80*b* continuously extends on the rear surface 78*e* of the contact supporting section 78*a* and the mount surface 78*d* of the guide wall section 78*b*.

The second terminal layers 80*c* are provided as external terminals of the connector 70, which are adapted to be electrically connected with the circuit (not shown) of the circuit board 16. In this embodiment, the external terminals further include solder bumps 80*d* provided on the respective second terminal layers 80*c* so as to bulge from the terminal layers 80*c*. The second terminal layers 80*c* or solder bumps 80*d* are preferably disposed in a staggered manner on the mount surface 78*d* to increase the insulation distance between the adjacent terminal layers 80*c* or solder bumps 80*d*.

The electro-conductive paths 80 of the plug connector 70 may be formed through substantially the same steps as those described in the first embodiment with reference to FIGS. 5A to 5C. It should be noted that a masking member (not shown) used in the third embodiment for forming the electro-conductive paths 80 is structured as a modification of the masking member 44 (FIG. 5B), wherein circular first openings, each of which has a dimension slightly larger than the dimension of the opening area of each through hole 82, are formed in the rear section 44*a* in place of the rectangular first openings 44*b*.

The board-locking members 36 are incorporated in the plug-type insulator 76 thus formed, to provide the insulator assembly 86 as mentioned above. Then, the contact elements 74 are inserted and press-fitted into the through holes 82, with the plug contact end 74*a* being first inserted from the rear surface 78*e* of the electro-insulating body 78, and fixedly supported in the plug-type insulator 76. Whereby, the plug connector 70 shown in FIG. 10 is provided, in which the contact elements 74 are electrically connected through the first terminal layers 80*a* and the conductive lines 80*b* to the second terminal layers 80*c* or solder bumps 80*d* as external terminals. Also, the plug connector 70 can be easily mounted in a proper position on the circuit board 16, as shown by arrows in FIG. 10, in substantially the same way as described in the first embodiment.

The plug connector 70 of the third embodiment possesses various exceptional and advantageous effects generally identical to those described in relation to the plug connector 10 of the first embodiment.

Figure 13:
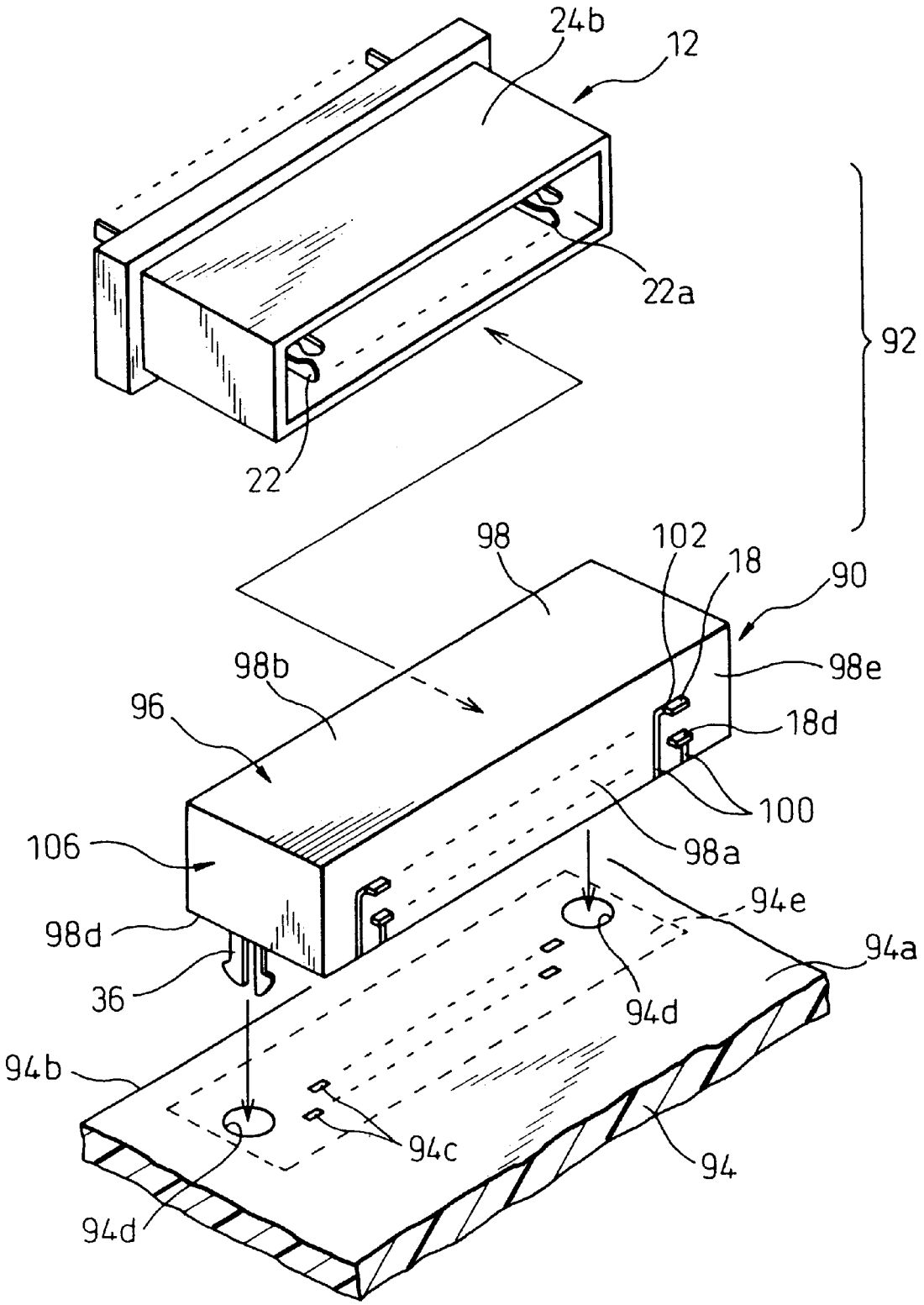
FIG. 13 is a perspective view of a plug connector according to the fourth embodiment of the present invention, together with a counterpart jack connector and a circuit board.

FIG. 13 shows an insert-mount type plug connector 90 as a fourth embodiment of a board-mount connector according to the present invention. The plug connector 90 is adapted to be detachably connected to the jack connector 12 described in relation to the first embodiment, as shown by an arrow, to provide a connector system 92 which is suitably used for connection between a circuit board 94 and another electrical component (not shown).

The plug connector 90 of the fourth embodiment has a structure generally similar to that of the plug connector 10 of the first embodiment with the exception of the features of a plug-type insulator 96 described below. The same or similar components in both embodiments are designated by common reference numerals, and the detailed description thereof need not be repeated.

The plug connector 90 includes a plurality of plug-type contact elements 18 and a plug-type insulator 96 securely holding therein the contact elements 18 in a mutually insulated arrangement. The plural contact elements 18 are arranged parallel to each other in a matrix with two upper and lower rows, in substantially the same way as in the plug connector 10.

The plug-type insulator 96 includes a plug-type electro-insulating body 98, and a plurality of electro-conductive paths 100 formed on the surface of the electro-insulating body 98 in substantially the same way as the electro-conductive paths 32 in the plug connector 10. The plug-type electro-insulating body 98 has a generally rectangular parallelepiped profile, and includes a contact supporting section 98*a* provided with a plurality of through holes 102 extending between the front and rear surface of the contact supporting section 98*a*, and a guide wall section 98*b* extending frontward from the peripheral edge area of the contact supporting section 98*a*.

The through holes 102 are arranged in a matrix with parallel upper and lower rows, in substantially the same way as the through holes 34 in the plug connector 10. Each through hole 102 has a generally rectangular cross section and a dimension sufficient to fix therein the fixing portion 18*b* (FIG. 2B) of the plug-type contact element 18 when the fixing portion 18*b* is inserted and press-fitted into the through hole 102, whereby the contact elements 18 are fixedly supported in parallel with each other in the contact supporting section 98*a*.

The guide wall section 98*b* is similar to the guide wall section 30*b* in the plug connector 10, and includes four peripheral walls serving to guide the guide wall section 24*b* of the jack connector 12. The flat, major outer surface of one peripheral wall of the guide wall section 98*b*, extending along the lower row of the through holes 102, acts as a mount surface 98*d* facing the surface 94*a* of the circuit board 94 when the plug connector 90 is mounted on the board surface 94*a*. The mount surface 98*d* thus extends substantially parallel to the contact elements 18 fixedly supported in the electro-insulating body 98.

The plug connector 90 of the fourth embodiment further includes a pair of board-locking members 36 respectively disposed near the longitudinally opposed edges of the mount surface 98*d* of the electro-insulating body 98. The board-locking members 36 are inserted and press-fitted into respective grooves 104 (FIG. 14D) formed in the guide wall section 98*b* of the electro-insulating body 98 in the mount surface 98*d* near the longitudinally opposed edges thereof, to provide an insulator assembly 106 of the plug connector 90, and serve as attachments of the plug connector 90 onto the surface 94*a* of the circuit board 94.

Figure 14A:
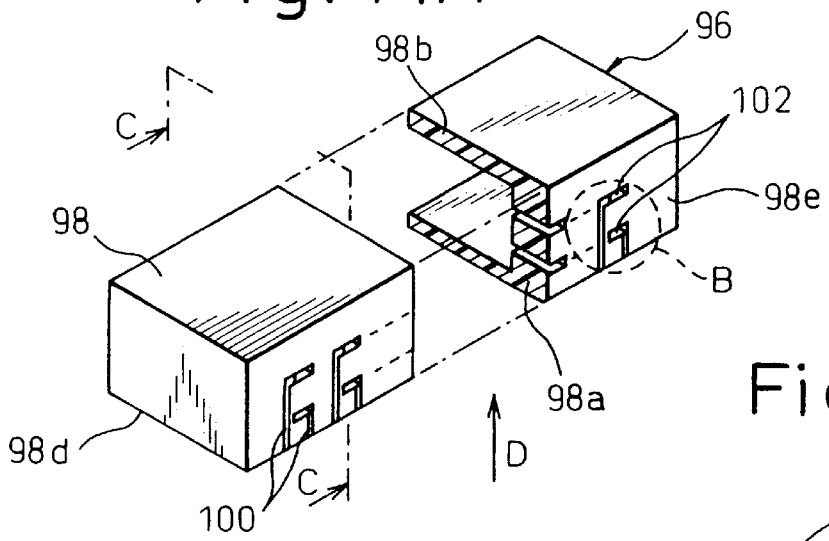
FIG. 14A is a partially cut-out perspective view of a plug-type insulator of the plug connector of FIG. 13.
Figure 14B:
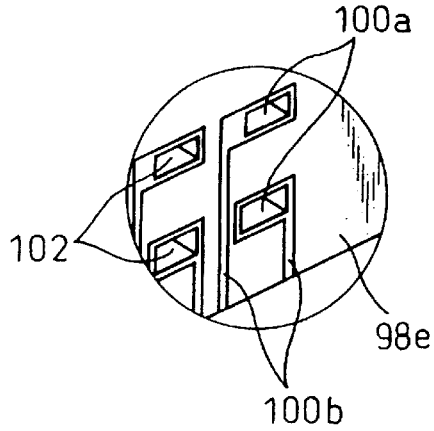
FIG. 14B is an enlarged perspective view of an encircled portion B in FIG. 14A.
Figure 14C:
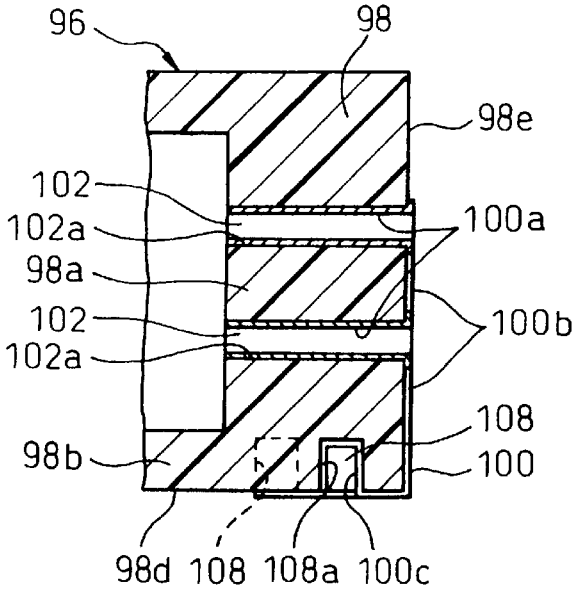
FIG. 14C is a sectional view taken along line C—C of FIG. 14A.
Figure 14D:
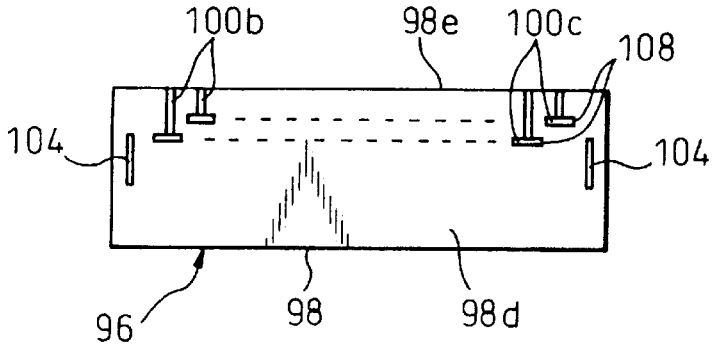
FIG. 14D is a bottom view from a direction shown by an arrow D of FIG. 14A.

FIGS. 14A to 14D illustrate in detail the electro-insulating body 98 and plural electro-conductive paths 100 of the plug-type insulator 96 of the plug connector 90. The electro-insulating body 98 further includes a plurality of second grooves 108 recessed into the electro-insulating body 98 on the mount surface 98*d* thereof and disposed in a certain array in substantially the same way as the second terminal layers 32*c* in the plug connector 10. The number of the second grooves 108 is the same as that of the through holes 102. The second grooves 108 are preferably disposed in a staggered manner on the mount surface 98*d* (FIG. 14D).

The electro-conductive paths 100 include first terminal layers 100*a* formed to cover the inner wall surfaces 102*a* of the through holes 102 in the electro-insulating body 98, conductive lines 100*b* formed in a certain pattern on the outer surface of the electro-insulating body 98 to be electrically connected at one end thereof with the respective first terminal layers 100*a*, and second terminal layers 100*c* formed to cover the inner wall surfaces 108*a* of the second grooves 108 to be electrically connected with the other end of the respective conductive lines 100*b*. The electro-conductive paths 100 are formed as laminas made of highly conductive metals, such as gold (Au), and are provided for the respective one of through holes 102 separately from one another in an electrically insulated manner.

As clearly shown in FIG. 14B, it is preferred that each first terminal layer 100*a* is slightly extended to the rear surface 98*e* to surround the opening edge of the through hole 102, to ensure the durability of the electrical connection between the first terminal layer 100*a* and the corresponding conductive line 100*b*. To the same end, it is also preferred that each second terminal layer 100 is slightly extended to the mount surface 98*d* to surround the opening edge of the second groove 108. Each conductive line 100*b* continuously extends on the rear surface 98*e* of the contact supporting section 98*a* and the mount surface 98*d* of the guide wall section 98*b*.

The second terminal layers 100*c* are provided as external terminals of the connector 90. In this embodiment, the external terminals further include terminal elements 110 (FIG. 16B), the number of which is the same as that of the contact elements 18. The terminal elements 110 are fixedly supported in the second grooves 108 formed in the mount surface 98*d* of the electro-insulating body 98, and are electrically connected with the respective contact elements 18 fixedly supported in the through holes 102 through the electro-conductive paths 100, to act as the external terminals to be connected with the circuit (not shown) in the circuit board 94. The second terminal layers 100*c* or terminal elements 110 are preferably disposed in a staggered manner on the mount surface 98*d* to increase the insulation distance between the adjacent terminal layers 100*c* or terminal elements 110.

Figure 15A:
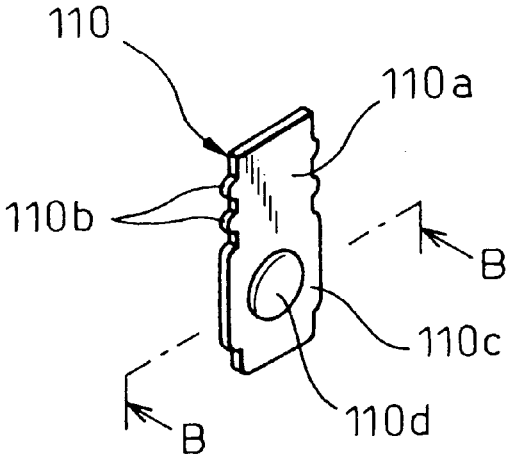
FIG. 15A is a perspective view of a terminal element used in the plug connector of FIG. 13.
Figure 15B:
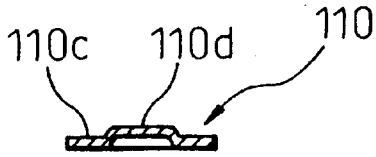
FIG. 15B is a sectional view taken along line B—B of FIG. 15A.

The terminal elements 110 may be prepared by stamping out a metal sheet by a conventional press technique. As shown in FIGS. 15A and 15B, each terminal element 110 has a flat plate shape, and includes a fixing end 110*a* adapted to be securely received in the second grooves 108 and provided with bulges 110*b* protruding from both lateral edges of the terminal element 110, and a board contact end 110*c* longitudinally adjacent to the fixing end 110*a* and provided with a curvedly deformed portion 110*d* formed by partially pressing the generally center portion of the fixing end 110*a* from one side of the fixing end 110*a*. Each second groove 108 has a generally rectangular cross section and a dimension sufficient to fix therein the fixing end 110*a* of the terminal element 110 with the aid of the bulges 110*b* thereof when the fixing end 110*a* is inserted and press-fitted into the second groove 108, whereby the terminal elements 110 are fixedly supported in the mount surface 98*d* of the electro-insulating body 98.

The electro-conductive paths 100 of the plug connector 90 may be formed through substantially the same steps as those described in the first embodiment with reference to FIGS. 5A to 5C. It should be noted that a masking member (not shown) used in the fourth embodiment for forming the electro-conductive paths 100 is structured as a modification of the masking member 44 (FIG. 5B), wherein rectangular second openings, each of which has dimensions slightly larger than the dimensions of the opening area of each second groove 108, are formed in the bottom section 44*c* in place of the generally circular second openings 44*d*. Whereby, the second terminal layers 100*c* are formed in the second grooves 108 simultaneously with the formation of the first terminal layers 100*a* in the through holes 102.

Figure 16A:
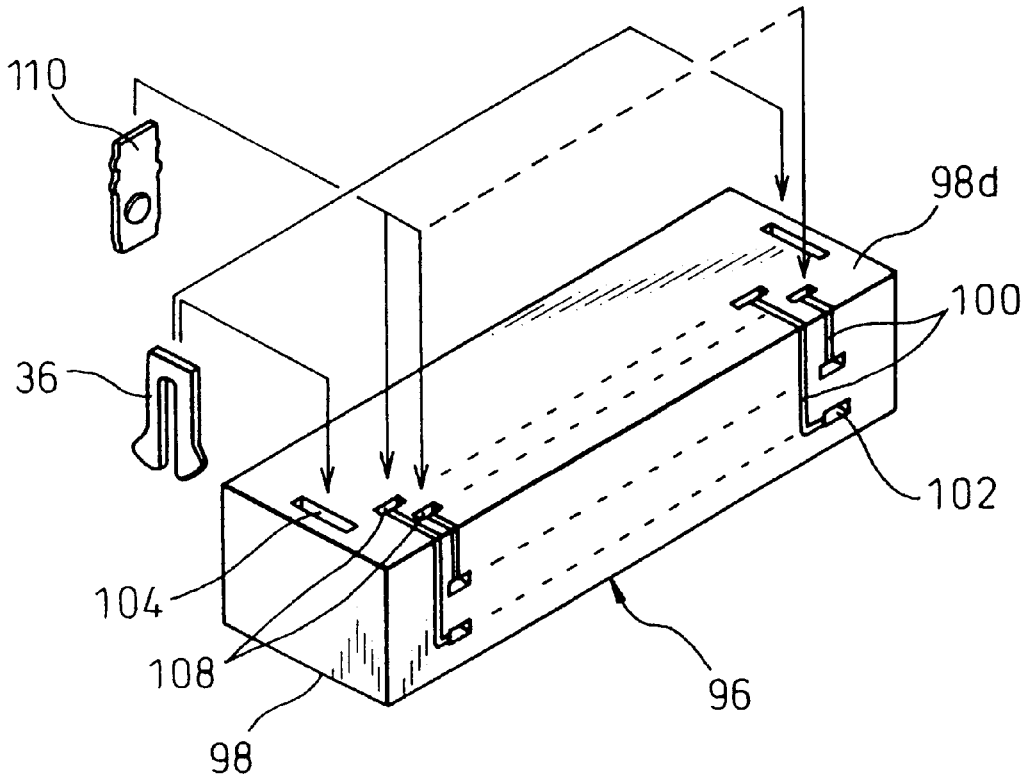
FIG. 16A is an exploded perspective view of an insulator assembly of the plug connector of FIG. 13 in a reversed position.
Figure 16B:
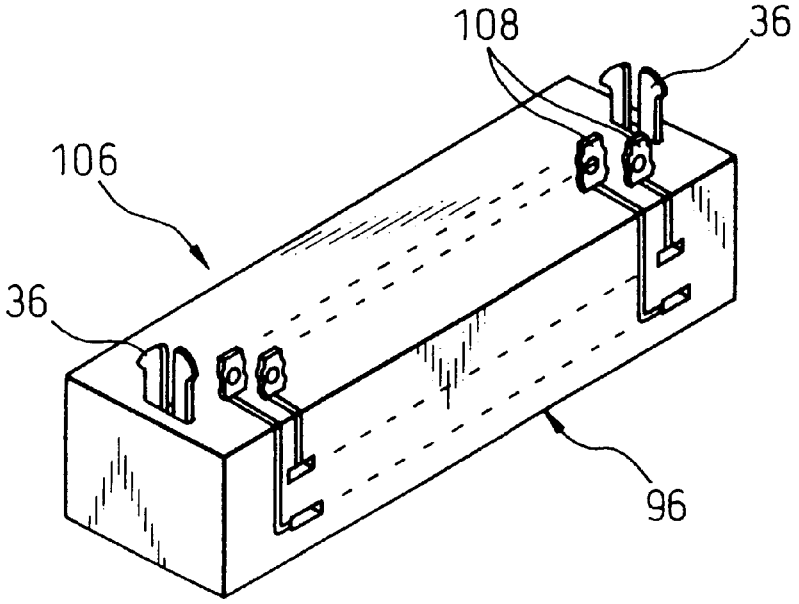
FIG. 16B is a perspective view of the insulator assembly of FIG. 16A in an assembled state.

As shown by arrows in FIG. 16A, when the board-locking members 36 and the plural terminal elements 110 are press-fitted into the grooves 108 and the second grooves 108, respectively, to be securely incorporated in the plug-type insulator 96 thus formed, the insulator assembly 106 is provided as mentioned above (FIG. 16B). Then, the contact elements 18 are press-fitted into the through holes 102 and fixedly supported in the plug-type insulator 96, in substantially the same way as described in the first embodiment. Whereby, the plug connector 90 shown in FIG. 13 is provided, in which the contact elements 18 are electrically connected through the first terminal layers 100*a*, the conductive lines 100*b* and the second terminal layers 100*c* to the terminal elements 110 as external terminals.

Referring again to FIG. 13, the circuit board 94, on which the plug connector 90 is mounted, is provided at the area adjacent to one edge 94*b* thereof with a plurality of terminal holes 94*c* connected with the circuit (not shown) formed in the circuit board 94. The terminal holes 94*c* are positioned on the surface 94*a* of the circuit board 94 correspondingly to the terminal elements 110 of the plug connector 90. Each terminal hole 94*c* has a generally rectangular cross section and dimensions sufficient to fix therein the board contact end 110*c* of the terminal element 110 with the aid of the curvedly deformed potion 10*d* thereof when the board contact end 110*c* is inserted and press-fitted into the terminal hole 94*c*.

In this respect, the terminal hole 94*c* is preferably dimensioned so that the board contact end 110*c* of the terminal element 110 is elastically deformed at the curvedly deformed portion 110*d* under compression when the board contact end 110*c* is press-fitted into the terminal hole 94*c*. The circuit board 94 is also provided with a pair of mount holes 94*d* located on the surface 94*a* of the circuit board 94 correspondingly to the board-locking members 36 of the plug connector 90, to receive the board-locking members 36.

The plug connector 90 may be mounted onto the circuit board 94, as shown by arrows in FIG. 13, by using any mounting devices. When the board-locking members 36 of the plug connector 90 are suitably received in the mount holes 94*d* and securely engaged therewith, the plug connector 90 is properly positioned on the circuit board 94, and at the same time, the terminal elements 110 are properly inserted and press-fitted into the terminal holes 94*c*. In this way, it is possible to ease the mounting operation of the plug connector 90.

The plug connector 90 of the fourth embodiment possesses various exceptional and advantageous effects generally identical to those described in relation to the plug connector 10 of the first embodiment. Also, the electro-conductive paths 100 of the plug connector 90 may be modified to be locally arranged on the surface of the electro-insulating body 98, in substantially the same way as described with reference to FIGS. 7A and 7B. In such a modification, it is further possible to increase the area for forming the circuit on the surface 94*a* of the circuit board 94, and thus to improve the productivity of the circuit board 94.

Figure 17:
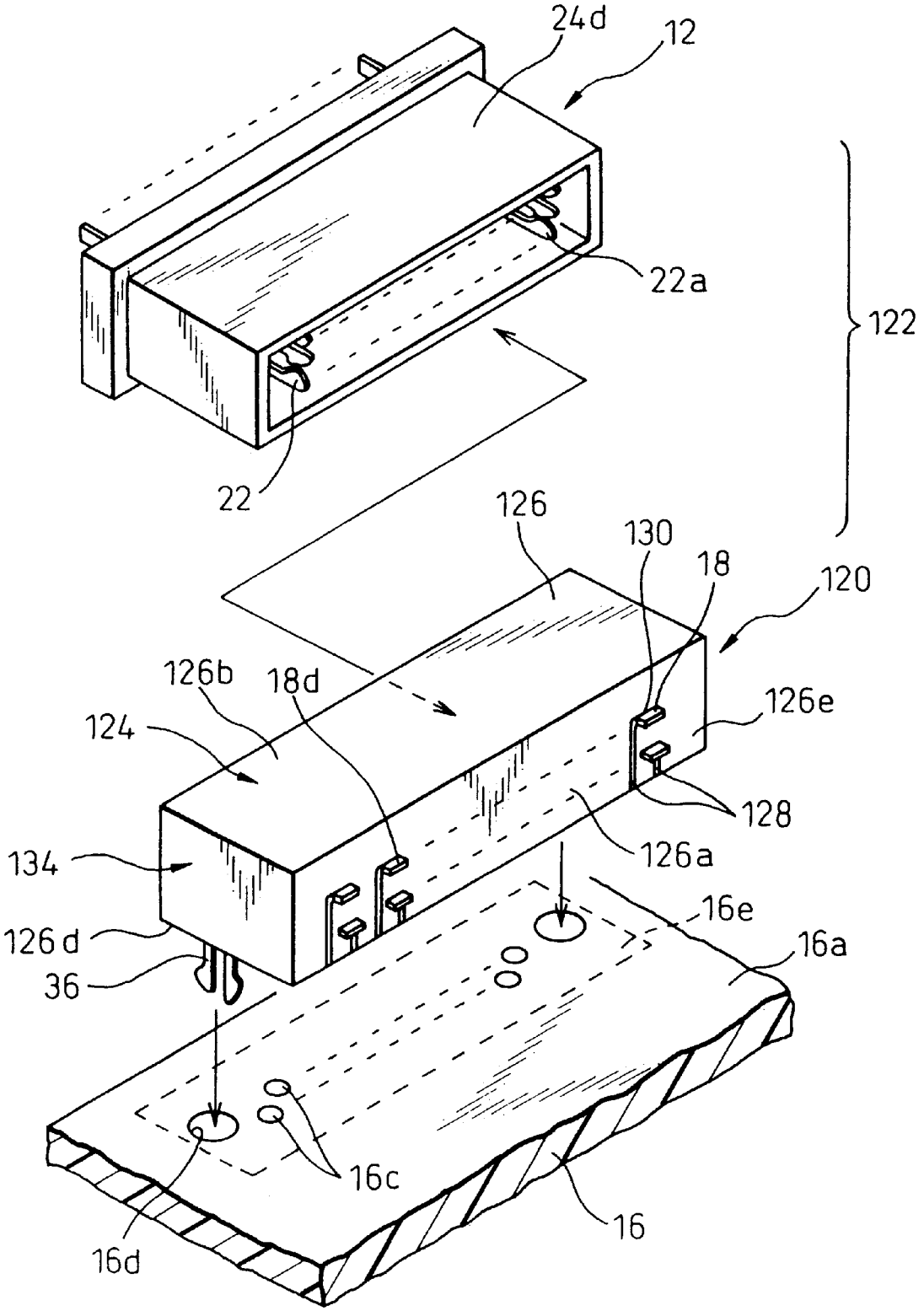
FIG. 17 is a perspective view of a plug connector according to the fifth embodiment of the present invention, together with a counterpart jack connector and a circuit board.

FIG. 17 shows a surface-mount type plug connector 120 as a fifth embodiment of a board-mount connector according to the present invention. The plug connector 120 is adapted to be detachably connected to the jack connector 12 described in relation to the first embodiment, as shown by an arrow, to provide a connector system 122 which is suitably used for connection between a circuit board 16 and another electrical component (not shown).

The plug connector 120 of the fifth embodiment has a structure generally similar to that of the plug connector 10 of the first embodiment with the exception of the features of a plug-type insulator 124 described below. The same or similar components in both embodiments are designated by common reference numerals, and the detailed description thereof need not be repeated.

The plug connector 120 includes a plurality of plug-type contact elements 18 and a plug-type insulator 124 securely holding therein the contact elements 18 in a mutually insulated arrangement. The plural contact elements 18 are arranged parallel to each other in a matrix with two upper and lower rows, in substantially the same way as in the plug connector 10.

The plug-type insulator 124 includes a plug-type electro-insulating body 126, and a plurality of electro-conductive paths 128 formed on the surface of the electro-insulating body 126 in substantially the same way as the electro-conductive paths 32 in the plug connector 10. The plug-type electro-insulating body 126 has a generally rectangular parallelepiped profile, and includes a contact supporting section 126*a* provided with a plurality of through holes 130 extending between the front and rear surfaces of the contact supporting section 126*a*, and a guide wall section 126*b* extending frontward from the peripheral edge area of the contact supporting section 126*a*.

The through holes 130 are arranged in a matrix with parallel upper and lower rows, in substantially the same way as the through holes 34 in the plug connector 10. Each through hole 130 has a generally rectangular cross section and a dimension sufficient to fix therein the fixing portion 18*b* (FIG. 2B) of the plug-type contact element 18 when the fixing portion 18*b* is inserted and press-fitted into the through hole 130, whereby the contact elements 18 are fixedly supported in parallel with each other in the contact supporting section 126*a*.

The guide wall section 126*b* is similar to the guide wall section 30*b* in the plug connector 10, and includes four peripheral walls serving to guide the guide wall section 24*b* of the jack connector 12. The flat, major outer surface of one peripheral wall of the guide wall section 126*b*, extending along the lower row of the through holes 130, acts as a mount surface 126*d* facing the surface 16*a* of the circuit board 16 when the plug connector 120 is mounted on the board surface 16*a*. The mount surface 126*d* thus extends substantially parallel to the contact elements 18 fixedly supported in the electro-insulating body 126.

The plug connector 120 of the fifth embodiment further includes a pair of board-locking members 36 respectively disposed near the longitudinally opposed edges of the mount surface 126*d* of the electro-insulating body 126. The board-locking members 36 are inserted and press-fitted into respective grooves 132 (FIG. 18D) formed in the guide wall section 126*b* of the electro-insulating body 126 in the mount surface 126*d* near the longitudinally opposed edges thereof, to provide an insulator assembly 134 of the plug connector 120, and serve as attachments of the plug connector 120 onto the surface 16*a* of the circuit board 16.

Figure 18A:
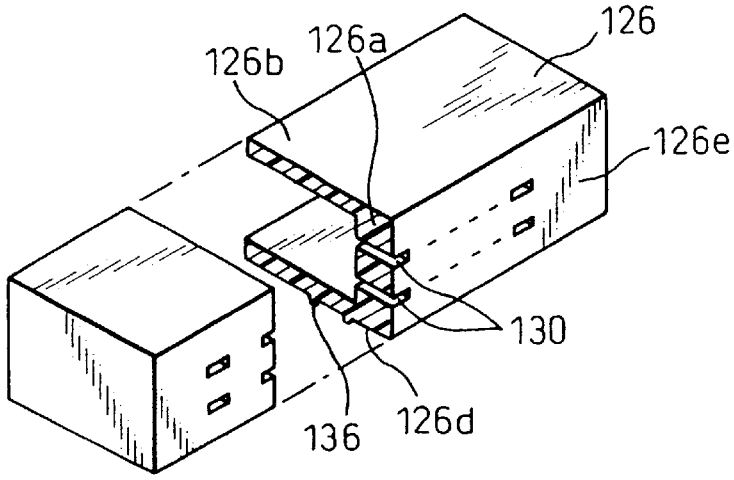
FIG. 18A is a partially cut-out perspective view of a plug-type electro-insulating body of the plug connector of FIG. 17.
Figure 18B:
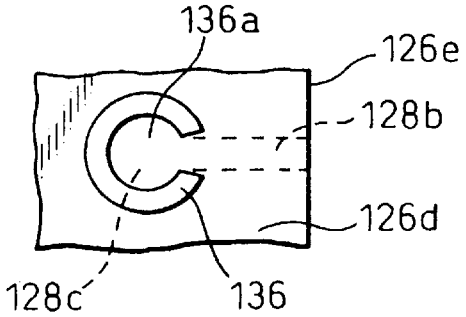
FIG. 18B is an enlarged bottom view of a part of the electro-insulating body of FIG. 18A.
Figure 18C:
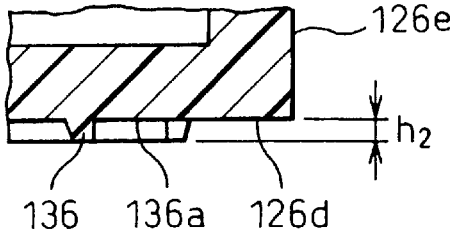
FIG. 18C is an enlarged sectional view of a part of the electro-insulating body of FIG. 18A.
Figure 18D:
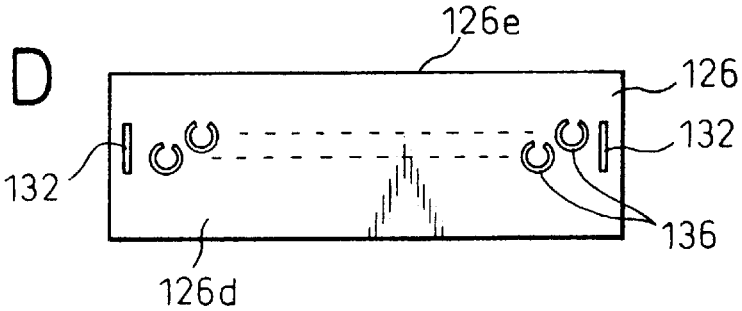
FIG. 18D is a bottom view of the electro-insulating body of FIG. 18A.

FIGS. 18A to 18D illustrate in detail the electro-insulating body 126 of the plug-type insulator 124 of the plug connector 120. The electro-insulating body 126 further includes a plurality of C-shaped projections 136 formed on the mount surface 126*d* and disposed in a certain array in substantially the same way as the second terminal layers 32*c* in the plug connector 10. The number of the C-shaped projections 136 is the same as that of the through holes 130. The C-shaped projections 136 are preferably disposed in a staggered manner on the mount surface 126*d* (FIG. 18D).

Each C-shaped projection 136 projects from the mount surface 126*d* to a height "$h_2$" which is smaller than a height "$h_1$" of a solder bump 128*d* (FIG. 19B) of the electro-conductive path 128 as described later. The generally cylindrical wall of the C-shaped projection 136 is cut out at a portion nearest a transitional edge between the mount surface 126*d* and the rear surface 126*e* of the electro-insulating body 126. The surface area 136*a* defined inside the C-shaped projection 136 communicates with the mount surface 126*d* through the cutout portion of the generally cylindrical wall to be flush with the mount surface 126*d*.

Figure 19A:
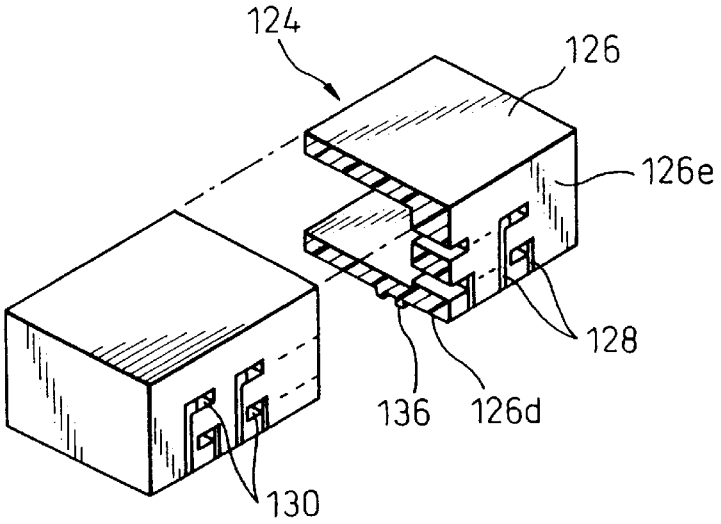
FIG. 19A is a partially cut-out perspective view of a plug-type insulator of the plug connector of FIG. 17.
Figure 19B:
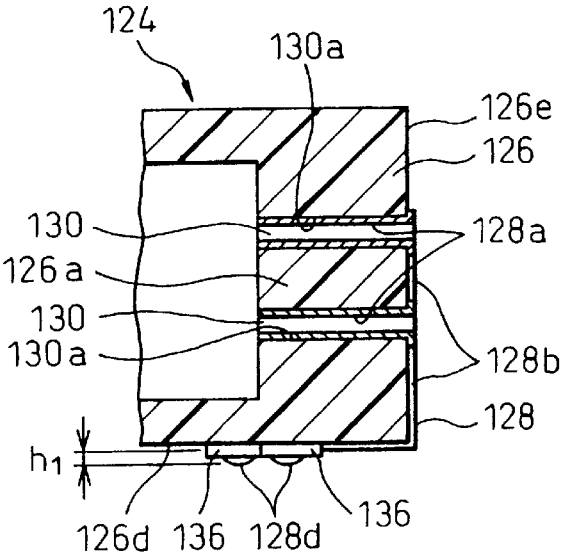
FIG. 19B is a sectional view of the plug-type insulator of FIG. 19A.
Figure 19C:
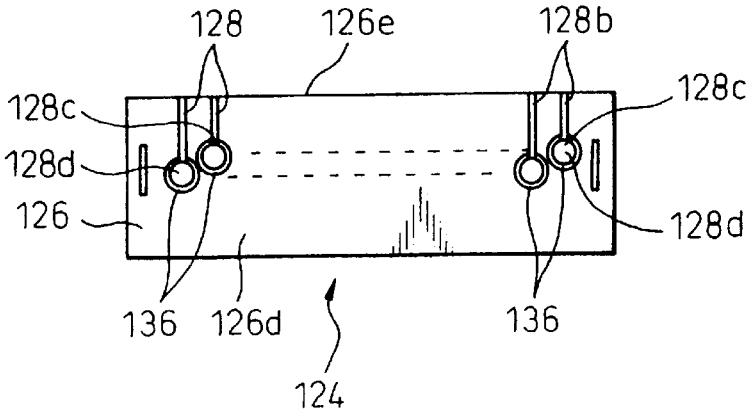
FIG. 19C is a bottom view of the plug-type insulator of FIG. 19A.

FIGS. 19A to 19C illustrate in detail the plural electro-conductive paths 128 of the plug-type insulator 124 of the plug connector 120. The electroconductive paths 128 include first terminal layers 128*a* formed to cover the inner wall surfaces 130*a* of the through holes 130 in the electro-insulating body 126, conductive lines 128*b* formed in a certain pattern on the outer surface of the electro-insulating body 126 to be electrically connected at one end thereof with the respective first terminal layers 128*a*, and second terminal layers 128*c* formed on the surface areas 136*a* inside the C-shaped projections 136 defined in the mount surface 126*d* to be electrically connected with the other end of the respective conductive lines 128*b*. The electro-conductive paths 128 are formed as laminas made of highly conductive metals, such as gold (Au), and are provided for the respective ones of through holes 130 separately from one another in an electrically insulated manner.

Each conductive line 128*b* continuously extends on the rear surface 126*e* of the contact supporting section 126*a* and the mount surface 126*d* of the guide wall section 126*b*. As shown by phantom lines in FIG. 18B, the conductive line 128*b* is smoothly connected with each second terminal layer 128*c* through the cut-out portion of the generally cylindrical wall of the C-shaped projections 136.

The second terminal layers 128*c* are provided as external terminals of the connector 120, which are adapted to be electrically connected with the circuit (not shown) of the circuit board 16. In this embodiment, the external terminals further include solder bumps 128*d* provided on the respective second terminal layers 128*c* so as to partially protrude from the C-shaped projections 136. The second terminal layers 128*c* or solder bumps 128*d* are preferably disposed in a staggered manner on the mount surface 126*d* to increase the insulation distance between the adjacent terminal layers 128*c* or solder bumps 128*d*.

Figure 20A:
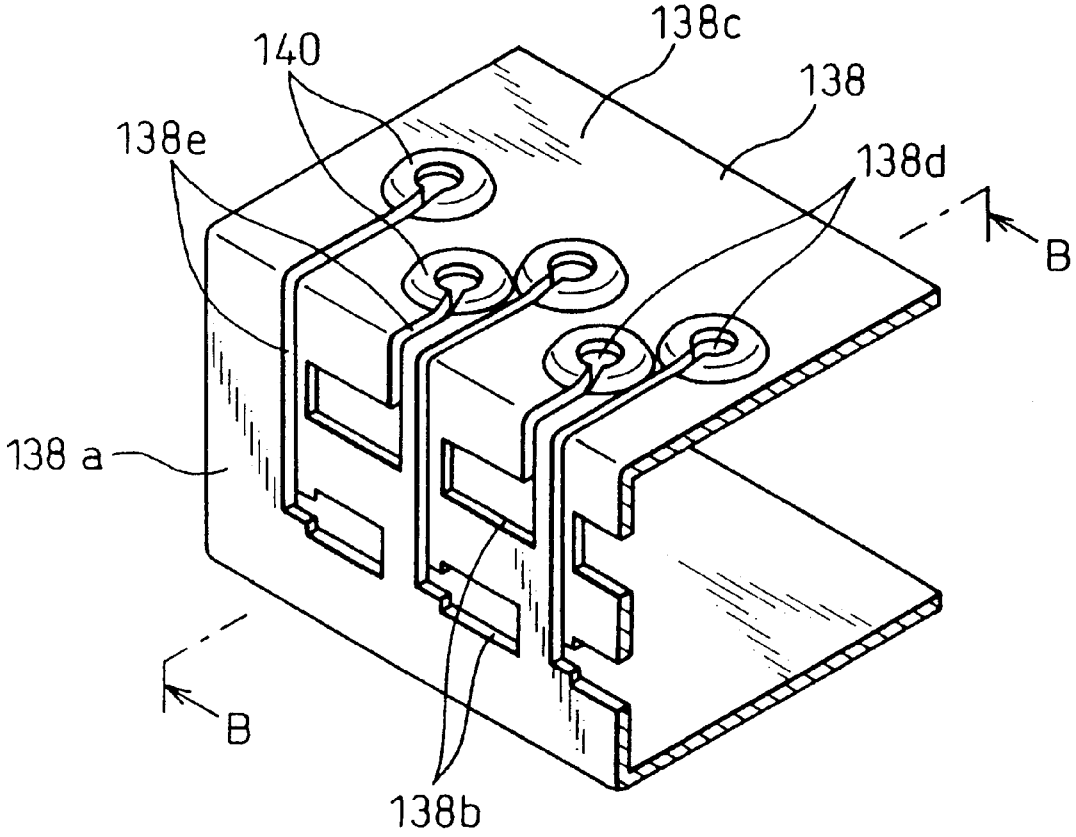
FIG. 20A is a perspective view of a part of a masking member used for forming electro-conductive paths of the plug-type insulator of FIG. 19A.
Figure 20B:
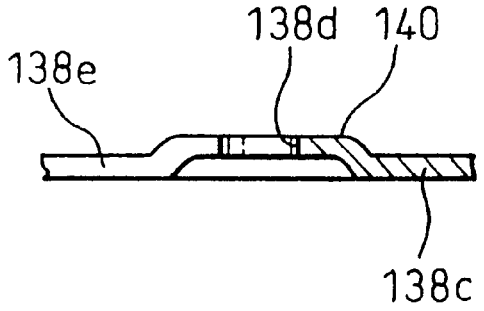
FIG. 20B is a sectional view taken along line B—B of FIG. 20A.

The electro-conductive paths 128 of the plug connector 120 may be formed through substantially the same steps as those described in the first embodiment with reference to FIGS. 5A to 5C. It should be noted that a masking member 138 used in the fifth embodiment for forming the electro-conductive paths 128 is structured as a modification of the masking member 44 (FIG. 5B). As shown in FIGS. 20A and 20B, the masking member 138 includes a rear section 138*a* provided with first openings 138*b*, a bottom section 138*c* provided with second openings 138*d*, and slits 138*e* formed through the rear and bottom sections 138*a*, 138*c*, which are substantially the same as the rear section 44*a*, first openings 44*b*, bottom section 44*c*, second openings 44*d* and slits 44*e* of the masking member 44, respectively.

The masking member 138 further includes C-shaped bulges 140 defining the respective second openings 138*d*. The C-shaped bulges 140 are formed by partially pressing outward the local areas of the bottom section 138*c* defining the second openings 138*d*, and located in the bottom section 138*c* correspondingly to the C-shaped projections 136 of the electro-insulating body 126. Each C-shaped bulge 140 extends to be capable of sufficiently covering the C-shaped projection 136 of the electro-insulating body 126 when the masking member 138 masks the outer surface of the electro-insulating body 126, and has a height from the bottom section 138*c* corresponding to the height "$h_2$" of the C-shaped projection 136.

The board-locking members 36 are incorporated in the plug-type insulator 124 thus formed, to provide the insulator assembly 134 as mentioned above. Then, the contact elements 18 are press-fitted into the through holes 130 and fixedly supported in the plug-type insulator 124, in substantially the same way as described in the first embodiment. Whereby, the plug connector 120 shown in FIG. 17 is provided, in which the contact elements 18 are electrically connected through the first terminal layers 128*a* and the conductive lines 128*b* to the second terminal layers 128*c* or solder bumps 128*d* as external terminals. Also, the plug connector 120 can be easily mounted in a proper position on the circuit board 16, as shown by arrows in FIG. 17, in substantially the same way as described in the first embodiment.

The plug connector 120 of the fifth embodiment possesses various exceptional and advantageous effects generally identical to those described in relation to the plug connector 10 of the first embodiment. Especially in the plug connector 120, since the-second terminal layers 128*c* of the electro-conductive paths 128 are surrounded by the C-shaped projections 136, it is possible to easily locate the solder balls, used for forming the solder bumps 128*d*, at the correct positions on the second terminal layers 128*c* on the mount surface 126*d* of the electro-insulating body 126. Consequently, the productivity of the plug connector 120 is improved. Also, the C-shaped projections 136 can determine and maintain the distance between the mount surface 126*d* of the plug connector 120 and the surface 16*a* of the circuit board 16, which improves the reliability of the mounting operation and performance of the plug connector 120 on the circuit board 16.

Figure 21:
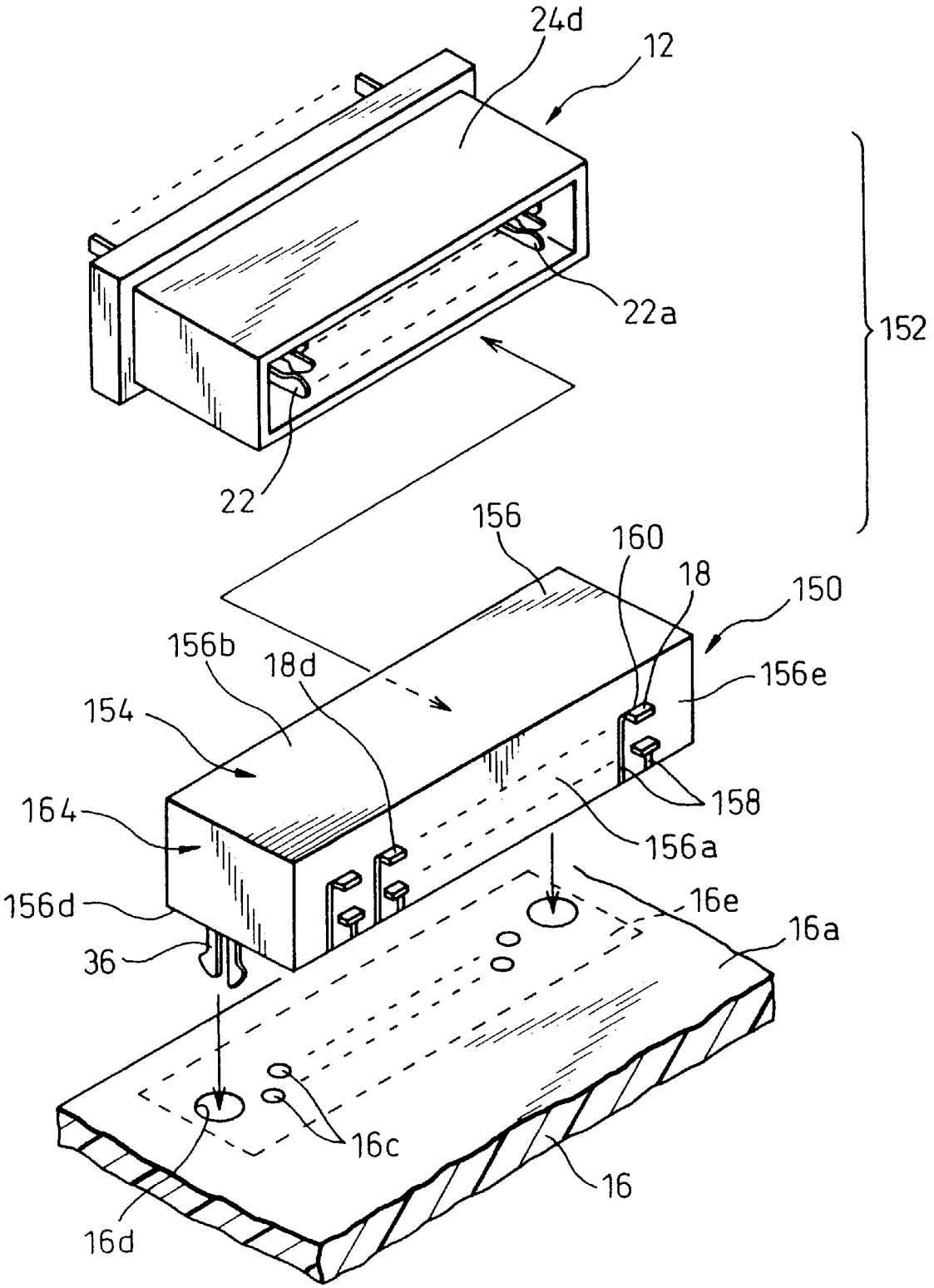
FIG. 21 is a perspective view of a plug connector according to the sixth embodiment of the present invention, together with a counterpart jack connector and a circuit board.

FIG. 21 shows a surface-mount type plug connector 150 as a sixth embodiment of a board-mount connector according to the present invention. The plug connector 150 is adapted to be detachably connected to the jack connector 12 described in relation to the first embodiment, as shown by an arrow, to provide a connector system 152 which is suitably used for connection between a circuit board 16 and another electrical component (not shown).

The plug connector 150 of the sixth embodiment has a structure generally similar to that of the plug connector 10 of the first embodiment with the exception of the features of a plug-type insulator 154 described below. The same or similar components in both embodiments are designated by common reference numerals, and the detailed description thereof need not be repeated.

The plug connector 150 includes a plurality of plug-type contact elements 18 and a plug-type insulator 154 securely holding therein the contact elements 18 in a mutually insulated arrangement. The plural contact elements 18 are arranged parallel to each other in a matrix with two upper and lower rows, in substantially the same way as in the plug connector 10.

The plug-type insulator 154 includes a plug-type electro-insulating body 156, and a plurality of electro-conductive paths 158 formed on the surface of the electro-insulating body 156 in substantially the same way as the electro-conductive paths 32 in the plug connector 10. The plug-type electro-insulating body 156 has a generally rectangular parallelepiped profile, and includes a contact supporting section 156*a* provided with a plurality of through holes 160 extending between the front and rear surface of the contact supporting section 156*a*, and a guide wall section 156*b* extending frontward from the peripheral edge area of the contact supporting section 156*a*.

The through holes 160 are arranged in a matrix with parallel upper and lower rows, in substantially the same way as the through holes 34 in the plug connector 10. Each through hole 160 has a generally rectangular cross section and dimensions sufficient to fix therein the fixing portion 18*b* (FIG. 2B) of the plug-type contact element 18 when the fixing portion 18*b* is inserted and press-fitted into the through hole 160, whereby the contact elements 18 are fixedly supported in parallel with each other in the contact supporting section 156*a*.

The guide wall section 156*b* is similar to the guide wall section 30*b* in the plug connector 10, and includes four peripheral walls serving to guide the guide wall section 24*b* of the jack connector 12. The flat, major outer surface of one peripheral wall of the guide wall section 156*b*, extending along the lower row of the through holes 160, acts as a mount surface 156*d* facing the surface 16*a* of the circuit board 16 when the plug connector 150 is mounted on the board surface 16*a*. The mount surface 156*d* thus extends substantially parallel to the contact elements 18 fixedly supported in the electro-insulating body 156.

The plug connector 150 of the sixth embodiment further includes a pair of board-locking members 36 respectively disposed near the longitudinally opposed edges of the mount surface 156*d* of the electro-insulating body 156. The board-locking members 36 are inserted and press-fitted into respective grooves 162 (FIG. 22D) formed in the guide wall section 156*b* of the electro-insulating body 156 in the mount surface 156*d* near the longitudinally opposed edges thereof, to provide an insulator assembly 164 of the plug connector 150, and serve as attachments of the plug connector 150 onto the surface 16*a* of the circuit board 16.

Figure 22A:
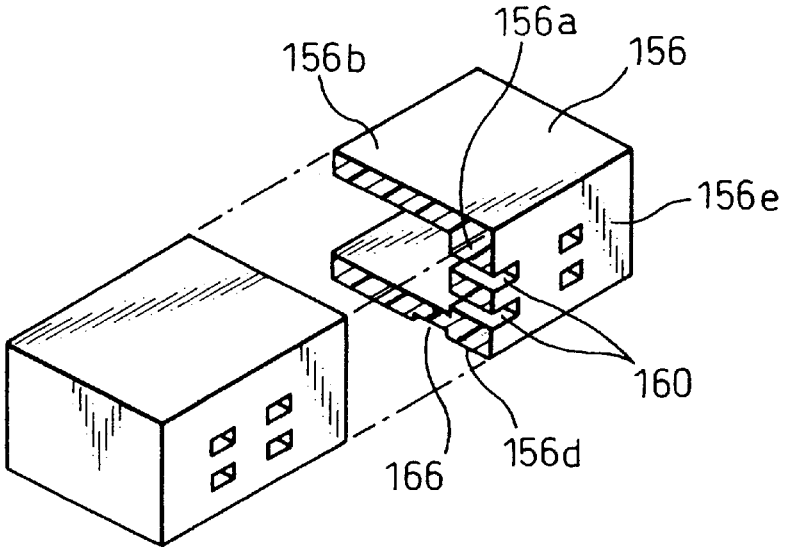
FIG. 22A is a partially cut-out perspective view of a plug-type electro-insulating body of the plug connector of FIG. 21.
Figure 22B:
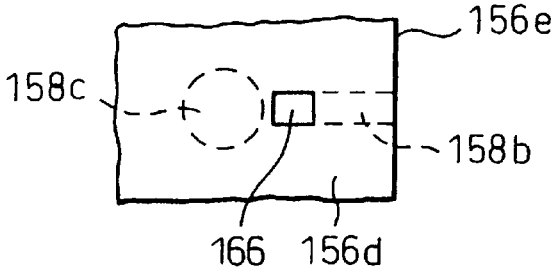
FIG. 22B is an enlarged bottom view of a part of the electro-insulating body of FIG. 22A.
Figure 22C:
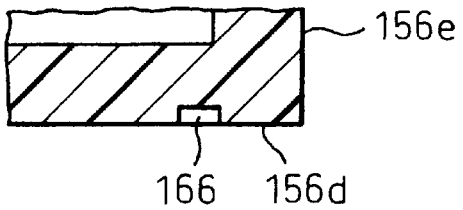
FIG. 22C is an enlarged sectional view of a part of the electro-insulating body of FIG. 22A.
Figure 22D:
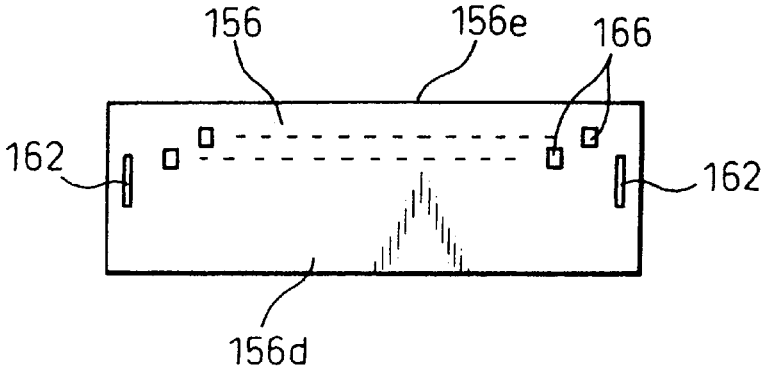
FIG. 22D is a bottom view of the electro-insulating body of FIG. 22A.

FIGS. 22A to 22D illustrate in detail the electro-insulating body 156 of the plug-type insulator 154 of the plug connector 150. The electro-insulating body 156 further includes a plurality of depressions 166 formed on the mount surface 156*d* and disposed in a certain array in substantially the same way as the second terminal layers 32*c* in the plug connector 10. The number of the depressions 166 is the same as that of the through holes 160. The depressions 166 are preferably disposed in a staggered manner in the mount surface 156*d* (FIG. 22D).

Each depression 166 is provided in the mount surface 156*d* at a position where the conductive line 158*b* (described later) of the electro-conductive path 158 are formed (as shown by phantom lines in FIG. 22B), and preferably has such dimensions that the depression 166 can be entirely covered by the conductive line 158*b*, or has the same width as that of the conductive line 158*b*.

Figure 23A:
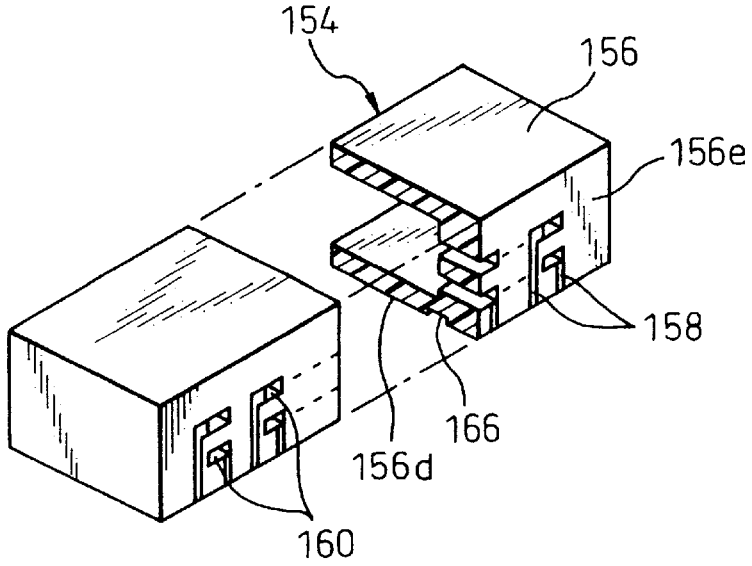
FIG. 23A is a partially cut-out perspective view of a plug-type insulator of the plug connector of FIG. 21.
Figure 23B:
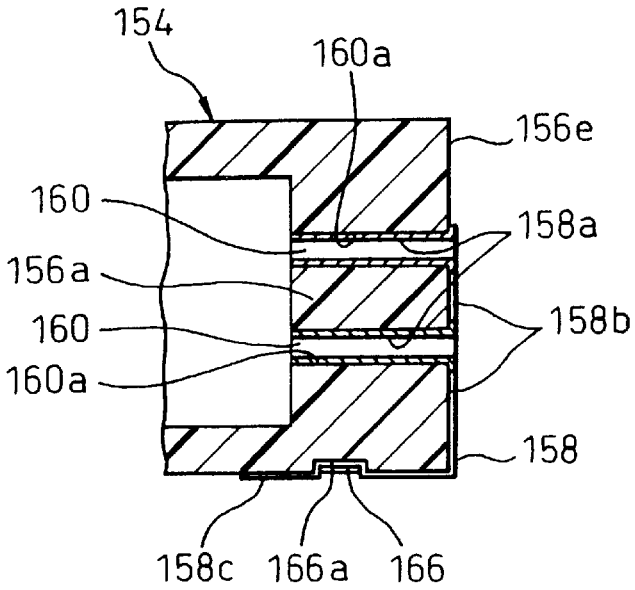
FIG. 23B is a sectional view of the plug-type insulator of FIG. 23A.
Figure 23C:
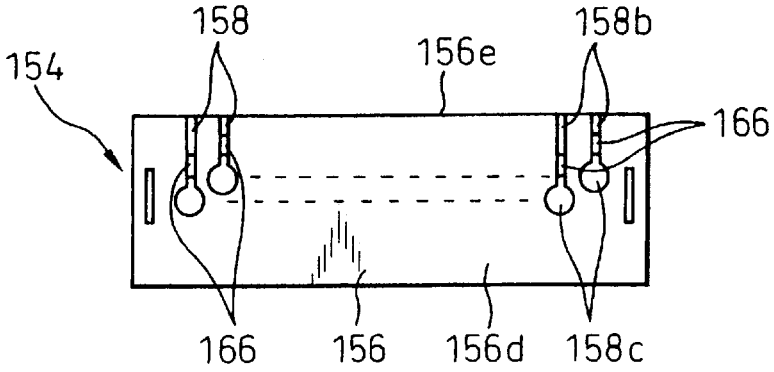
FIG. 23C is a bottom view of the plug-type insulator of FIG. 23A.

FIGS. 23A to 23C illustrate in detail the plural electro-conductive paths 158 of the plug-type insulator 154 of the plug connector 150. The electro-conductive paths 158 include first terminal layers 158*a* formed to cover the inner wall surfaces 160*a* of the through holes 160 in the electro-insulating body 156, conductive lines 158*b* formed in a certain pattern on the outer surface of the electro-insulating body 156 to be electrically connected at one end thereof with the respective first terminal layers 158*a*, and second terminal layers 158*c* formed on the mount surface 156*d* adjacent to the depressions 166 to be electrically connected with the other end of the respective conductive lines 158*b*. The electro-conductive paths 158 are formed as laminas made of highly conductive metals, such as gold (Au), and are provided for the respective ones of through holes 160 separately from one another in an electrically insulated manner.

Each conductive line 158*b* continuously extends on the rear surface 156*e* of the contact supporting section 156*a* and the mount surface 156*d* of the guide wall section 156*b*. The conductive line 158*b* also extends on the inner surface of the depression 166 at a position adjacent to the second terminal layer 158*c*. The second terminal layers 158*c* are provided as external terminals of the connector 150, which are adapted to be electrically connected with the circuit (not shown) of the circuit board 16. Also, the external terminals may further include solder bumps (not shown) provided on the respective second terminal layers 158*c*. The second terminal layers 158*c* are preferably disposed in a staggered manner on the mount surface 156*d* to increase the insulation distance between the adjacent terminal layers 158*c*. The electro-conductive paths 158 of the plug connector 150 may be formed through substantially the same steps as those described in the first embodiment with reference to FIGS. 5A to 5C.

The board-locking members 36 are incorporated in the plug-type insulator 154 thus formed, to provide the insulator assembly 164 as mentioned above. Then, the contact elements 18 are press-fitted into the through holes 160 and fixedly supported in the plug-type insulator 154, in substantially the same way as described in the first embodiment. Whereby, the plug connector 150 shown in FIG. 21 is provided, in which the contact elements 18 are electrically connected through the first terminal layers 158*a* and the conductive lines 158*b* to the second terminal layers 158*c* as external terminals. Also, the plug connector 150 can be easily mounted in a proper position on the circuit board 16, as shown by arrows in FIG. 21, in substantially the same way as described in the first embodiment.

The plug connector 150 of the sixth embodiment possesses various exceptional and advantageous effects generally identical to those described in relation to the plug connector 10 of the first embodiment. Especially in the plug connector 150, since the second terminal layers 158*c* of the electro-conductive paths 158 are disposed adjacent to the depressions 166, it is possible to prevent the molten solder or solder bumps from brimming over the predetermined area defined on the second terminal layers 158*c* during a heating process since the excess molten solder flows into the depressions 166 and is held therein. Consequently, the problem of short circuit between the adjacent second terminal layers 158*c* and/or conductive lines 158*b* can be effectively prevented. Also, the depressions 166 serve to prevent the molten solder from flowing along the conductive lines 158*b* toward the first terminal layer 158*a*, and thus prevent the reduction of the solder on the second terminal layers 158*c*.

Figure 24A:
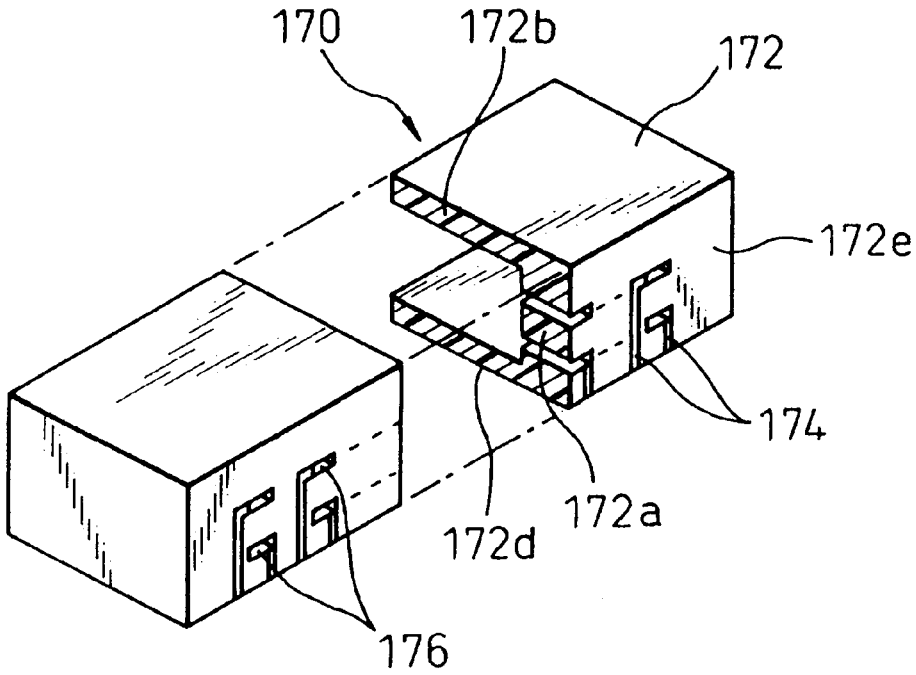
FIG. 24A is a partially cut-out perspective view of a plug-type insulator of a plug connector according to the seventh embodiment of the present invention.
Figure 24B:
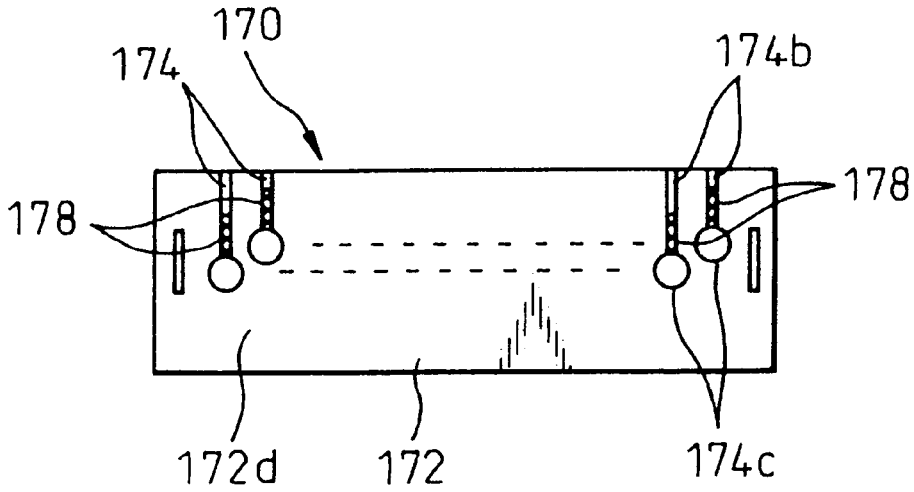
FIG. 24B is a bottom view of the plug-type insulator of FIG. 24A.

The present invention may provide another means for preventing the flow of the molten solder along the electro-conductive paths and thus preventing the reduction of the solder on the second terminal layers. FIGS. 24A and 24B show a plug-type insulator 170 of a surface-mount type plug connector as a seventh embodiment of a board-mount connector according to the present invention, which includes such flow preventing means. The plug-type insulator 170 has a structure generally similar to the plug-type insulator 154 of the plug connector 150 of the sixth embodiment with the exception of the features of the flow preventing means.

The plug-type insulator 170 includes a plug-type electro-insulating body 172, and a plurality of electro-conductive paths 174 formed on the surface of the electro-insulating body 172 in substantially the same way as the electro-conductive paths 158 in the plug connector 150. The plug-type electro-insulating body 172 has a generally rectangular parallelepiped profile, and includes a contact supporting section 172*a* provided with a plurality of through holes 176 extending between the front and rear surfaces of the contact supporting section 172*a*, and a guide wall section 172*b* extending frontward from the peripheral edge area of the contact supporting section 172*a*.

The plug-type insulator 170 further includes metal surface areas 178 having little wetability for solder, which are defined on the respective electro-conductive paths 174, and which act as the flow preventing means. Each metal surface area 178 is provided on the conductive line 174*b* of the electro-conductive path 174 and is preferably located adjacent to the second terminal layer 174*c* thereof.

Figure 25A:
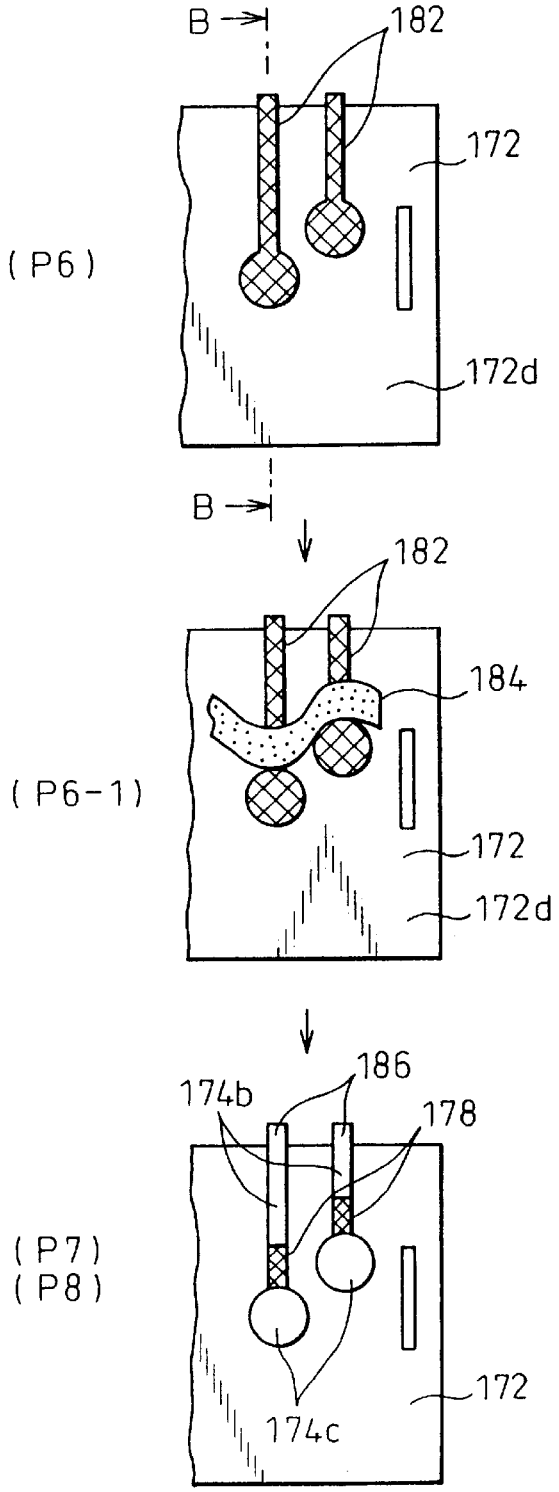
FIG. 25A is an enlarged bottom view of a part of the plug-type insulator of FIG. 24A, showing steps of forming metal surface areas.
Figure 25B:
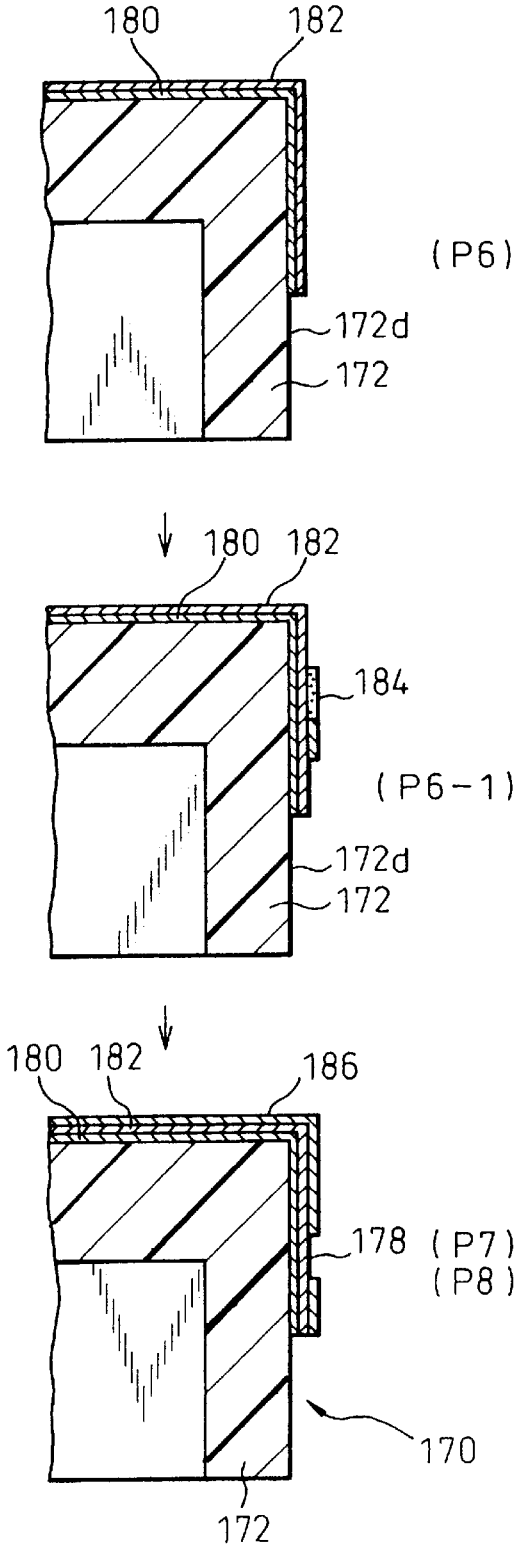
FIG. 25B is an enlarged sectional view of a part of the plug-type insulator, corresponding to FIG. 25A.

The metal surface area 178 may be formed in the steps for forming the electro-conductive paths 174, which is substantially the same as described in the first embodiment with reference to FIGS. 5A to 5C. As shown in FIG. 25A and 25B, the copper plate layers 180 are formed on the surface of the electro-insulating body 172, and the nickel plate layers 182 are formed on the copper plate layers 180, both layers 180, 182 having been profiled in the shape of electro-conductive paths 174, in the step P6 as described in relation to FIG. 5A. Note in these figures, the electroless copper plate layer and the resist previously applied on the surface of the electro-insulating body 172 outside the layers 180, 182 are omitted to simplify the drawings.

Then, in additional step P6-1, another resist 184, which is of the same material as the previously applied resist, is applied for covering the local surface areas of the nickel plate layers 182, the local surface areas preferably being adjacent to locations on the mount surface 172*d* at which the second terminal layers 174*c* are formed. Thereafter, in the step P7, the gold plate layers 186 are formed on the surface areas on the nickel plate layers 182 outside the resist 184, and in the step P8, the resist 184 is removed together with the previously applied resist. By etching the previously applied electroless copper plate layer in the step P9, the electro-conductive paths 174 including the partially exposed nickel plate layers 182, which serve as the metal surface areas 178 having little wetability for solder, are formed on the electro-insulating body 172, as shown in FIGS. 24A and 24B.

In the plug connector including the above plug-type insulator 170, since the second terminal layers 174*c* of the electro-conductive paths 174 are disposed adjacent to the metal surface areas 178 having little wetability for solder, it is possible that the metal surface areas 178 prevent the molten solder or solder bumps from flowing along the conductive lines 174*b*, and thus the reduction of the solder on the second terminal layers 174*c* can be effectively prevented.

It will be appreciated that the flow preventing means, such as the depressions 166 or the metal surface areas 178, may be incorporated in the plug connector 120 of the fifth embodiment. In this case, the depressions 166 or the metal surface areas 178 may be located adjacent to the C-shaped projections 136. In this modification, it is possible to ease the formation of the solder bumps 128*d* and to prevent the reduction of the solder on the terminal layers 158*c* by suppressing the flow of the molten solder along the electro-conductive paths 158.

While the invention has been particularly shown and described with reference to preferred embodiments thereof, it will be understood by those skilled in the art that various changes and modifications may be made without departing from the spirit and scope of the invention. For example, the present invention may be applied to a jack connector including a jack-type insulator and jack-type contact elements, which could possess the generally identical effects to those described in the above embodiments. In any events, the scope of the invention is therefore to be determined solely by the appended claims.

What is claimed is:

1. A connector, comprising:

a plurality of contact elements;

an electro-insulating body for supporting said contact elements in a mutually insulated arrangement, said electro-insulating body including a first section fixedly supporting therein said contact elements and a second section extending from said first section so as to surround said contact elements, said first section defining a first outer surface of said electro-insulating body and said second section defining a generally flat second outer surface of said electro-insulating body adjacent to said first outer surface;

a plurality of external terminals located on said second outer surface of said electro-insulating body; and a plurality of electro-conductive paths formed on a surface of said electro-insulating body to be electrically connected with respective ones of said contact elements and respective ones of said external terminals, said electro-conductive paths continuously extending on said first and second outer surfaces;

wherein said external terminals are provided at respective ends of portions of said electro-conductive paths, said portions extending on said second outer surface.

2. The connector of claim 1, wherein said electro-conductive paths are formed as conductive laminas in a certain pattern on said surface of said electro-insulating body.

3. The connector of claim 1, wherein said electro-conductive paths include terminal layers formed in a desired array on said second outer surface of said electro-insulating body, and wherein said external terminals include solder bumps provided on respective ones of said terminal layers.

4. The connector of claim 3, wherein said terminal layers of said electro-conductive paths are grouped together in a local area of said second outer surface of said electro-insulating body.

5. The connector of claim 3, wherein said electro-insulating body is provided in a desired array on said outer surface with C-shaped projections, each C-shaped projection having a height not higher than a height of each of said solder bumps, and wherein said terminal layers are formed inside respective ones of said C-shaped projections.

6. The connector of claim 3, wherein said electro-insulating body is provided in a desired array on said outer surface with depressions, electro-conductive paths being formed in said depressions, and wherein said terminal layers are formed adjacent to respective ones of said depressions.

7. The connector of claim 3, wherein said electro-conductive paths are provided locally with metal surface areas having little wetability for solder, said metal surface areas being located adjacent to respective ones of said terminal layers.

8. The connector of claim 7, wherein said metal surface areas are made of nickel layers.

9. The connector of claim 1, wherein said external terminals include terminal elements securely supported in a desired array on said outer surface of said electro-insulating body.

10. The connector of claim 9, wherein said terminal elements are grouped together in a local area on said outer surface of said electro-insulating body.

11. The connector of claim 1, wherein said electro-insulating body includes through holes provided in said first section for securely holding therein respective ones of said contact elements, and wherein said electro-conducive paths include first terminal layers formed to cover inner surfaces of said through holes, conductive lines formed in a certain pattern on said first and second outer surfaces of said electro-insulating body to be electrically connected at one ends thereof with said first terminal layers, and second terminal layers formed in a desired array on said second outer surface of said electro-insulating body to be electrically connected with other ends of said conductive lines, said external terminals being provided on said second terminal layers.

12. The connector of claim 11, wherein said external terminals include solder bumps provided on respective ones of said second terminal layers.

13. The connector of claim 11, wherein said electro-insulating body is provided in said outer surface with a plurality of grooves, said second terminal layers of said electro-conductive paths being formed to cover inner surfaces of said grooves, and wherein said external terminals include terminal elements press-fitted into respective ones of said grooves.

14. The connector of claim 1, wherein said electro-insulating body is provided in said outer surface with a recessed portion, said electro-conductive paths being formed on a surface of said recessed portion.

15. The connector of claim 1, wherein said contact elements include contact ends adapted to be engaged with counterpart contact elements, fixing portions adjacent to said contact ends to be fixed in said first section of said electro-insulating body, and terminal ends adjacent to said fixing portions opposite to said contact ends, said terminal ends slightly projecting from said first outer surface of said electro-insulating body.

16. A board-mount connector for a circuit board, comprising:

a plurality of contact elements having a substantially straight shape;

an electro-insulating body for supporting said contact elements in a mutually parallel, insulated arrangement, said electro-insulating body including a first section fixedly supporting therein said contact elements and a second section extending from said first section so as to surround said contact elements, said first section defining a first outer surface of said electro-insulating body and said second section defining a generally flat second outer surface of said electro-insulating body adjacent to said first outer surface, said second outer surface being a mount surface extending substantially parallel to said contact elements and adapted to face a surface of the circuit board;

a plurality of external terminals located on said mount surface of said electro-insulating body; and a plurality of electro-conductive paths formed on a surface of said electro-insulating body to be electrically connected with respective ones of said contact elements and respective ones of said external terminals, said electro-conductive paths continuously extending on said first outer surface and said mount surface;

wherein said external terminals are provided at respective ends of portions of said electro-conductive paths, said portions extending on said mount surface.

17. The board-mount connector of claim 16, wherein said external terminals are grouped together in a local area of said mount surface of said electro-insulating body.

18. A board-mount connector for a circuit board, comprising:

a plurality of contact elements having a substantially straight shape, each of said contact elements including a contact end adapted to be engaged with a counterpart contact element, a fixing portion adjacent to said contact end, and a terminal end adjacent to said fixing portion opposite to said contact end;

an electro-insulating body for supporting said contact elements in a mutually parallel, insulated arrangement, said electro-insulating body including first section fixedly supporting therein said contact elements and a second section extending from said first section so as to surround said contact elements, said first section defining a first outer surface of said electro-insulating body and said second section defining a generally flat second outer surface of said electro-insulating body adjacent to said first outer surface, and also including through holes arranged in a desired array in said first section, each of said through holes having dimensions for fixing therein said fixing portion of said each contact element, and said second outer surface being a mount surface extending substantially parallel to said contact elements and adapted to face a surface of the circuit board;

a plurality of external terminals concentrically located in a desired area on said mount surface of said electro-insulating body; and a plurality of electro-conductive paths formed on a surface of said electro-insulating body to be electrically connected with respective ones of said contact elements and respective ones of said external terminals, each of said electro-conductive paths including a first terminal layer formed to cover an inner surface of said each through hole, a conductive line continuously formed on said first outer surface and said mount surface of said electro-insulating body to be electrically connected at one end thereof with said first terminal layer, and a second terminal layer formed on said mount surface of said electro-insulating body to be electrically connected with another end of said conductive line, each of said external terminals being provided on said second terminal layer.

19. A board mounted connector for a circuit board, comprising a plurality of contact elements;

an electro-insulating body for supporting said contact elements, said electro-insulating body including a first outer surface and a second outer surface adjacent to each other, the first outer surface supporting the plurality of contacts with the second outer surface extending so as to surround said contact elements, the second outer surface being generally flat;

a plurality of external terminal being located on the second outer surface; and a plurality of electro-conductive paths formed on a surface of the electro-insulating body and continuously extending on said first and second outer surfaces;

wherein the external terminals are provided at ends of portions of the electro-conductive paths.

* * * * *